US008093965B2

(12) United States Patent
Mittelstadt et al.

(10) Patent No.: US 8,093,965 B2
(45) **Date of Patent: *Jan. 10, 2012**

(54) ADD-ON TRIP MODULE FOR MULTI-POLE CIRCUIT BREAKER

(75) Inventors: Chad R. Mittelstadt, Cedar Rapids, IA (US); Cameron Woodson, Cedar Rapids, IA (US)

(73) Assignee: Schneider Electric USA, Inc., Palatine, IL (US)

( * ) Notice: Subject to any disclaimer, the term of this patent is extended or adjusted under 35 U.S.C. 154(b) by 380 days.

This patent is subject to a terminal disclaimer.

(21) Appl. No.: 12/354,354

(22) Filed: Jan. 15, 2009

(65) Prior Publication Data

US 2010/0134221 A1 Jun. 3, 2010

Related U.S. Application Data

(63) Continuation-in-part of application No. 12/327,323, filed on Dec. 3, 2008, and a continuation-in-part of application No. 12/345,313, filed on Dec. 29, 2008.

(51) Int. Cl.
*H01H 75/00* (2006.01)
*H01H 77/00* (2006.01)
*H01H 83/00* (2006.01)

(52) U.S. Cl. ..... 335/8; 335/6

(58) Field of Classification Search ..... 335/6, 8
See application file for complete search history.

(56) References Cited

U.S. PATENT DOCUMENTS 3,162,739 A * 12/1964 Klein et al. ..... 335/9
3,264,435 A * 8/1966 Klein et al. ..... 337/48
3,353,128 A * 11/1967 Gauthier ..... 335/35
4,486,803 A 12/1984 Zylstra
4,691,182 A * 9/1987 Mrenna et al. ..... 335/176
4,719,438 A * 1/1988 Mrenna et al. ..... 335/38
4,821,008 A * 4/1989 Micoud et al. ..... 335/189
4,931,757 A * 6/1990 Lemmer et al. ..... 335/131
5,218,331 A * 6/1993 Morris et al. ..... 335/18
5,304,761 A * 4/1994 Rosen et al. ..... 218/157
5,608,367 A * 3/1997 Zoller et al. ..... 335/132
5,670,922 A 9/1997 Montague et al.
6,054,912 A * 4/2000 Kaneko et al. ..... 335/172
6,087,913 A * 7/2000 Castonguay et al. ..... 335/16
6,101,992 A * 8/2000 Pischinger et al. ..... 123/90.11
6,144,271 A * 11/2000 Mueller et al. ..... 335/202
6,175,288 B1 * 1/2001 Castonguay et al. ..... 335/16
6,229,418 B1 * 5/2001 Mueller et al. ..... 335/202
6,239,677 B1 * 5/2001 Ramakrishnan et al. ..... 335/35
6,337,449 B1 1/2002 Brouillat et al.
6,369,340 B1 * 4/2002 Castonguay et al. ..... 200/244
6,788,174 B1 * 9/2004 Afshari et al. ..... 335/42
7,323,956 B1 * 1/2008 Puskar et al. ..... 335/6
2001/0027961 A1 10/2001 Brouillat et al.
2007/0241846 A1 * 10/2007 Puskar et al. ..... 335/6

* cited by examiner

*Primary Examiner* — Lincoln Donovan
*Assistant Examiner* — Alexander Talpalatskiy

(57) ABSTRACT

An add-on module adapted to be attached to the basic mechanical structure of a multi-pole circuit breaker includes multiple extended terminal plates each of which is adapted to replace one of the input and output terminals for one of the poles, multiple electromechanical transducers each of which is coupled to one of the extended terminal plates for producing a mechanical movement in response to a predetermined magnitude of electrical current in the extended terminal plate to which that transducer is coupled, a mechanical actuator coupled to the electromechanical transducers and to the movable contacts for operating the trip mechanism in response to a predetermined movement of any of the transducers, and a calibration element for adjusting mechanical movement of at least one of said multiple electromechanical transducers so as to control an aspect of trip actuation.

20 Claims, 26 Drawing Sheets

ADD-ON TRIP MODULE FOR MULTI-POLE CIRCUIT BREAKER

CROSS-REFERENCE TO RELATED APPLICATIONS

This application is a continuation-in-part of U.S. application Ser. No. 12/327,323,filed Dec. 3, 2008 and entitled "Add-On Trip Module for Multi-Pole Circuit Breaker" and U.S. application Ser. No. 12/345,313,filed Dec. 29, 2008 and entitled "Add-On Trip Module for Multi-Pole Circuit Breaker."

FIELD OF THE INVENTION

The present invention relates to add-on modules for multi-pole circuit breakers and, more particularly, to an add-on trip module capable of utilizing the basic mechanical structure of a multiple-pole electronic-trip circuit breaker while replacing the electronic trip actuator with an electromechanical actuator.

BACKGROUND OF THE INVENTION

Multi-pole circuit breakers utilizing electronic actuators for actuating trip mechanisms in response to the detection of various types of fault conditions have become highly developed. The cost of these devices has been controlled in part by mass production of the basic mechanical structure of the breaker (sometimes referred to as the "platform" of the circuit breaker), as well as the electronic portions. These sophisticated circuit breakers, however, are not typically applicable to DC power systems, and available DC electronic trip units are very expensive because traditional current measurement transformers cannot generate their own power in a absence of alternating current, so they must use complex iron cores that move inside a wire bobbin at a set trip current level providing a one-time power generation to fire a solenoid, or an external power supply combined with a Hall effect sensor that can continuously monitor DC current levels.

SUMMARY OF THE INVENTION

An add-on module is provided for the basic mechanical structure of a multiple-pole circuit breaker. The basic mechanical structure includes, for each pole:

- a power input terminal and a power output terminal,
- a pair of contacts each of which is connected to a different one of the terminals and at least one of which is movable,
- a trip mechanism coupled to the movable contact for opening the contacts by disengaging the movable contact from the other contact in the pair, and
- a manually operable actuator coupled to said movable contact for operating and resetting the trip mechanism.

In one embodiment, the add-on module is adapted to be attached to the basic mechanical structure and includes:

- multiple extended terminal plates each of which is adapted to replace one of the terminal plates for one of the phase lines,
- multiple electromechanical transducers each of which is coupled to one of the extended terminal plates for producing a mechanical movement in response to a predetermined magnitude of electrical current in the extended terminal plate to which that transducer is coupled,
- a mechanical actuator coupled to the electromechanical transducers and to the movable contacts for operating the trip mechanism in response to a predetermined movement of any of the transducers, and
- a calibration element for adjusting mechanical movement of at least one of said multiple electromechanical transducers so as to control an aspect of trip actuation.

One implementation of the calibration element comprises calibration elements for adjusting the predetermined magnitude of electrical current at which the mechanical movement is produced by the transducers. For example, each transducer may include a biasing spring resisting the mechanical movement until the electrical current in the extended terminal plate to which that transducer is coupled is increased to a predetermined level, and each calibration element may include an adjustment device coupled to the biasing spring for adjusting the resisting force of the biasing spring and thereby adjusting the predetermined level of electrical current.

In another embodiment, the add-on module is adapted to be attached to the basic mechanical structure and includes:

- multiple electromechanical transducers each of which includes a stationary ferromagnetic element coupled to one of the extended terminal plates and a movable ferromagnetic element spaced from the stationary ferromagnetic element by an air gap and mounted for mechanical movement in response to a predetermined magnitude of electrical current in the extended terminal plate to which the stationary ferromagnetic element is coupled, and
- an adjustment screw for adjusting the position of each of the movable ferromagnetic elements so as to change the size of the air gap between the movable ferromagnetic element and the corresponding stationary ferromagnetic element.

In one implementation, the add-on module includes a housing that has multiple apertures each of which is associated with one of the transducers, and each of the adjustment screws extends into one of the apertures so that the screw is accessible for adjustment from outside the housing.

In a further embodiment, the add-on module is adapted to be attached to the basic mechanical structure and includes:

- multiple electromechanical transducers each of which includes a movable element and is coupled to one of the extended terminal plates for producing a mechanical movement of the movable element in response to a predetermined magnitude of electrical current in the extended terminal plate to which the transducer is coupled, and
- multiple dashpots each of which is coupled to one of the movable elements for controlling the rate of movement of the movable element.

The control features of the add-on modules permit the electronic sensing and trip-actuating portions of an electronic multi-pole circuit breaker to be easily replaced with an electromechanical sensing and trip-actuating device suitable for use with AC and DC power systems, while permitting (1) adjustment of the predetermined magnitude of electrical current at which the mechanical movement is produced by the transducers, (2) adjustment of the positions of movable ferromagnetic elements so as to change the size of air gaps between movable ferromagnetic elements and corresponding stationary ferromagnetic elements, and/or (3) control of the rate of movement of the movable elements to allow creation of complex trip characteristics. The basic mechanical structure of the host circuit breaker used with the electronic actuator is used with the add-on modules, thus taking advantage of the economics of mass production of that basic mechanical structure. The add-on module themselves can be manufactured and assembled at a relatively low cost because they have a small number of parts that are easily assembled.

BRIEF DESCRIPTION OF THE DRAWINGS

The invention may best be understood by reference to the following description taken in conjunction with the accompanying drawings, in which.

DETAILED DESCRIPTION OF THE ILLUSTRATED EMBODIMENTS

Although the invention will be described in connection with certain preferred embodiments, it will be understood that the invention is not limited to those particular embodiments. On the contrary, the invention is intended to cover all alternatives, modifications, and equivalent arrangements as may be included within the spirit and scope of the invention as defined by the appended claims.

Figure 1:
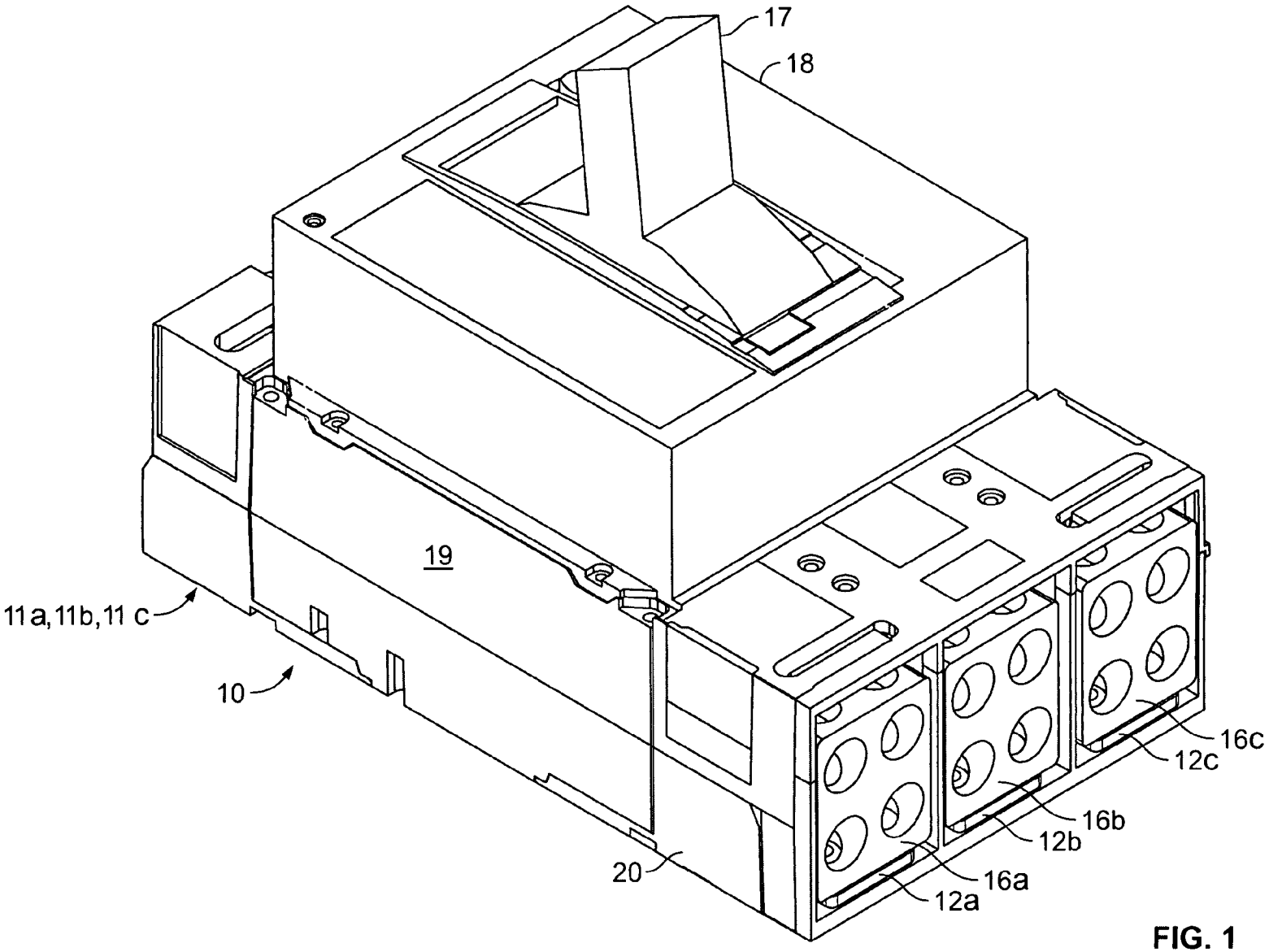
FIG. 1 is a perspective view of a multiple-pole circuit breaker equipped with an add-on module that includes a mechanical actuator for the trip mechanism in the basic mechanical structure of the breaker.
Figure 2:
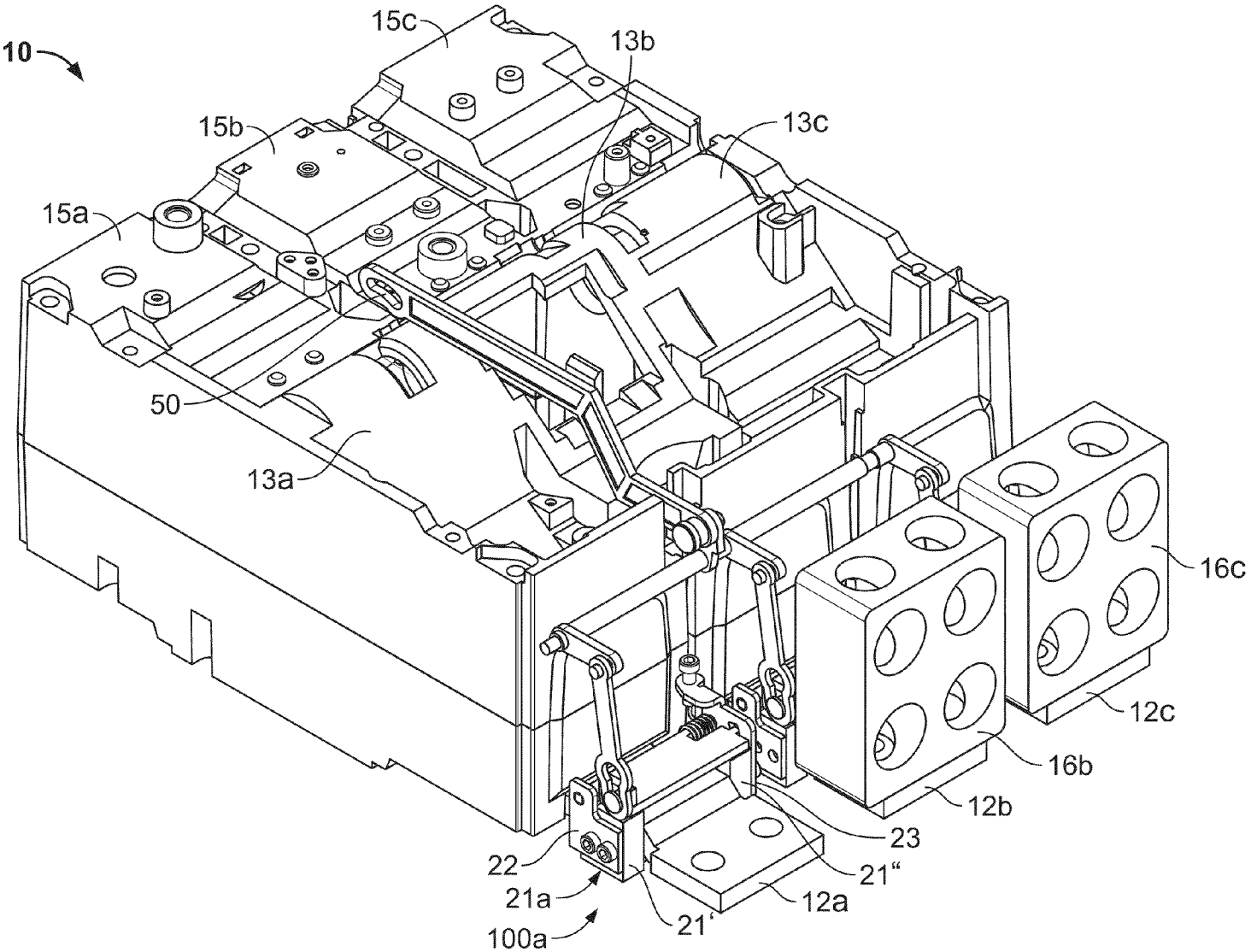
FIG. 2 is an enlarged perspective view of the basic mechanical structure of the circuit breaker of FIG. 1 with the housing removed and having an add-on module attached to one end of the basic mechanical structure.
Figure 3:
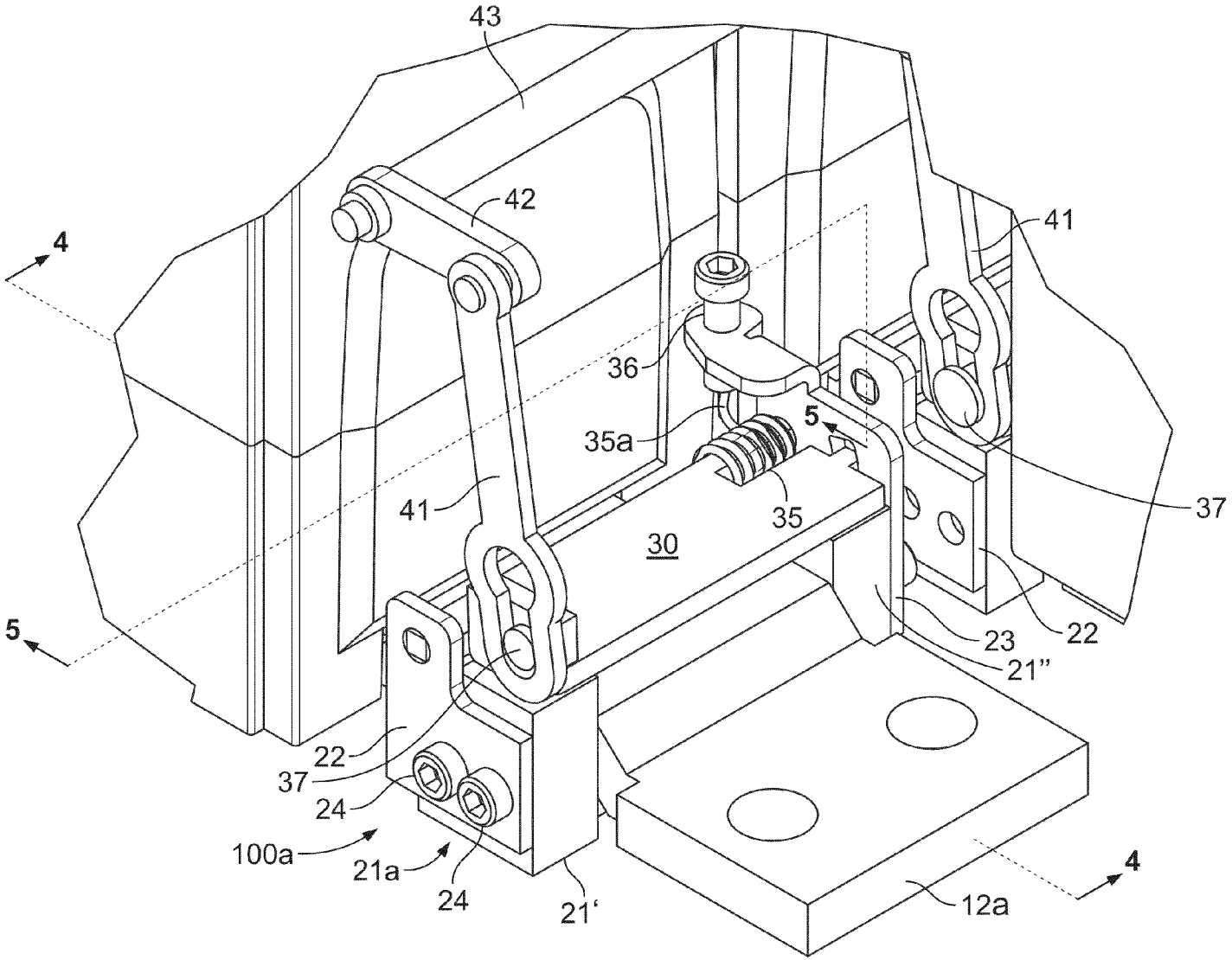
FIG. 3 is an enlarged perspective view of the lower front corner of the structure shown in FIG. 2.

Turning now to the drawings, FIGS. 1 and 2 illustrate a three-pole circuit breaker in which the basic mechanical structure 10 includes three power input terminals 11*a*-11*c*, three power output terminals 12*a*-12*c*, and three trip mechanisms 13*a*-13*c* for opening and closing three pairs of contacts, collectively 14*a*-14*c* (see FIGS. 9 and 10), connected to respective pairs of input and output terminals. Arc suppression chambers 15*a*-15*c* adjacent the three pairs of contacts dissipate and extinguish the arcs that occur when the breaker contacts are opened. Three lugs are positioned over each of the two sets of terminals, such as the lugs 16*a*-16*c* shown in FIGS. 1 and 2 over the output terminals 12*a*-12*c*.

A manually operated toggle 17 permits the breaker contacts to be opened and closed manually, and also permits the trip mechanisms 13*a*-13*c* to be simultaneously reset following a trip. The toggle 17 extends outwardly from an auxiliary housing 18 attached to a main body housing 19, which has been removed in FIG. 2. The mechanisms contained in the basic mechanical structure 10 of the illustrative host circuit breaker are well known and are described in numerous publications, such as U.S. Pat. No. 6,337,449 and U.S. Patent Application Publication No. US 2001/0027961 A1 assigned to the assignee of the present invention.

The basic mechanical structure 10 of the illustrative circuit breaker is capable of being tripped by an electronic trip system that includes at least three current sensors that produce signals related to the electrical current flowing between the input and output terminals 12*a*-12*c* when the breaker contacts are closed. These signals from s the current sensors are supplied to a control circuit that uses the signals to detect the occurrence of a fault condition, and then produce an electrical trip signal when a fault condition is detected. The trip signal is typically supplied to one or more solenoids having armatures coupled to the trip mechanisms 13*a*-13*c* to open the three pairs of contacts 14*a*-14*c*. Such electronic trip systems are well known and are described in numerous publications, such as U.S. Pat. No. 4,486,803 assigned to the assignee of the present invention.

Figure 4:
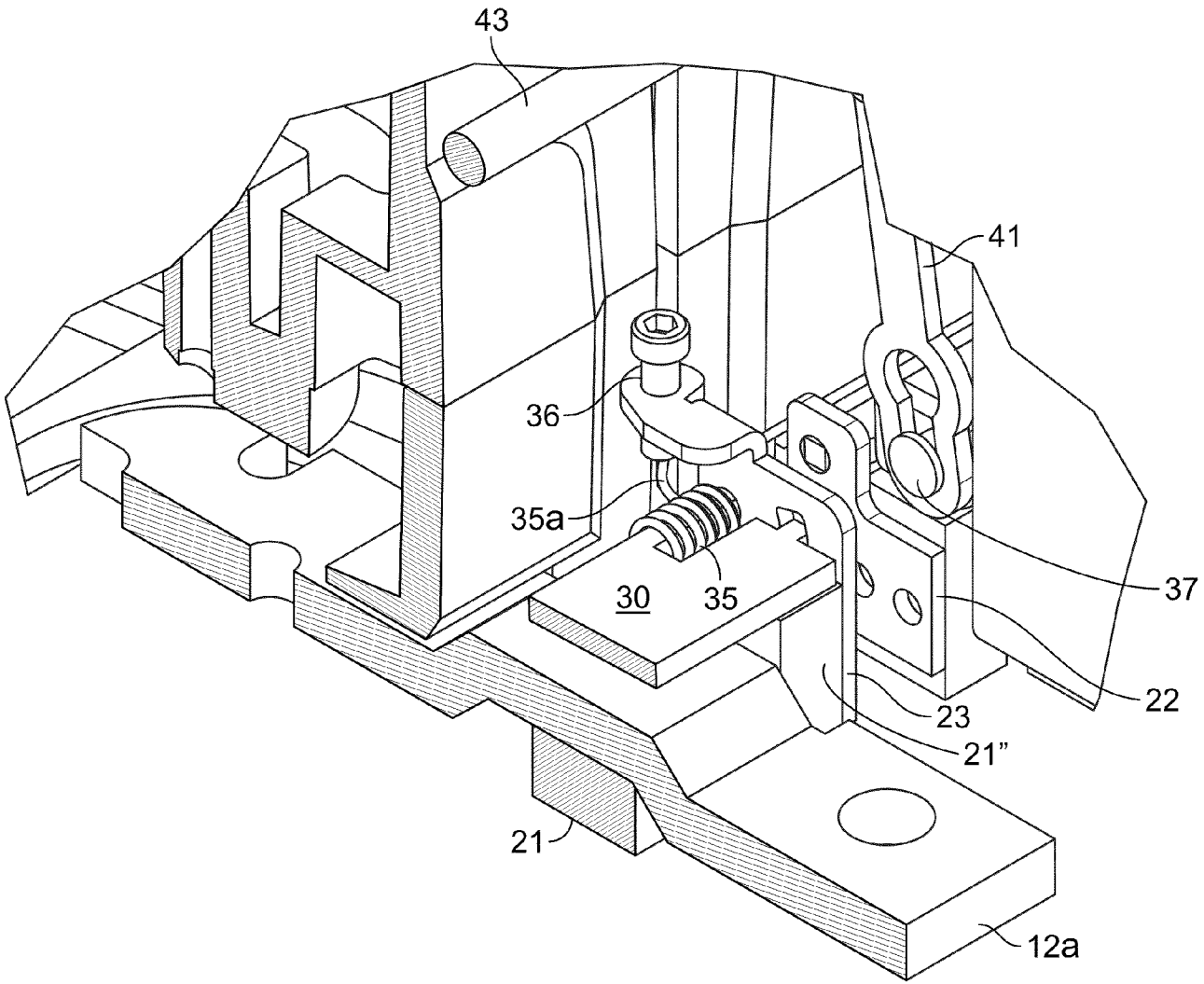
FIG. 4 is a sectional view of the structure shown in FIG. 3 taken along line 4-4 in FIG. 3.
Figure 5:
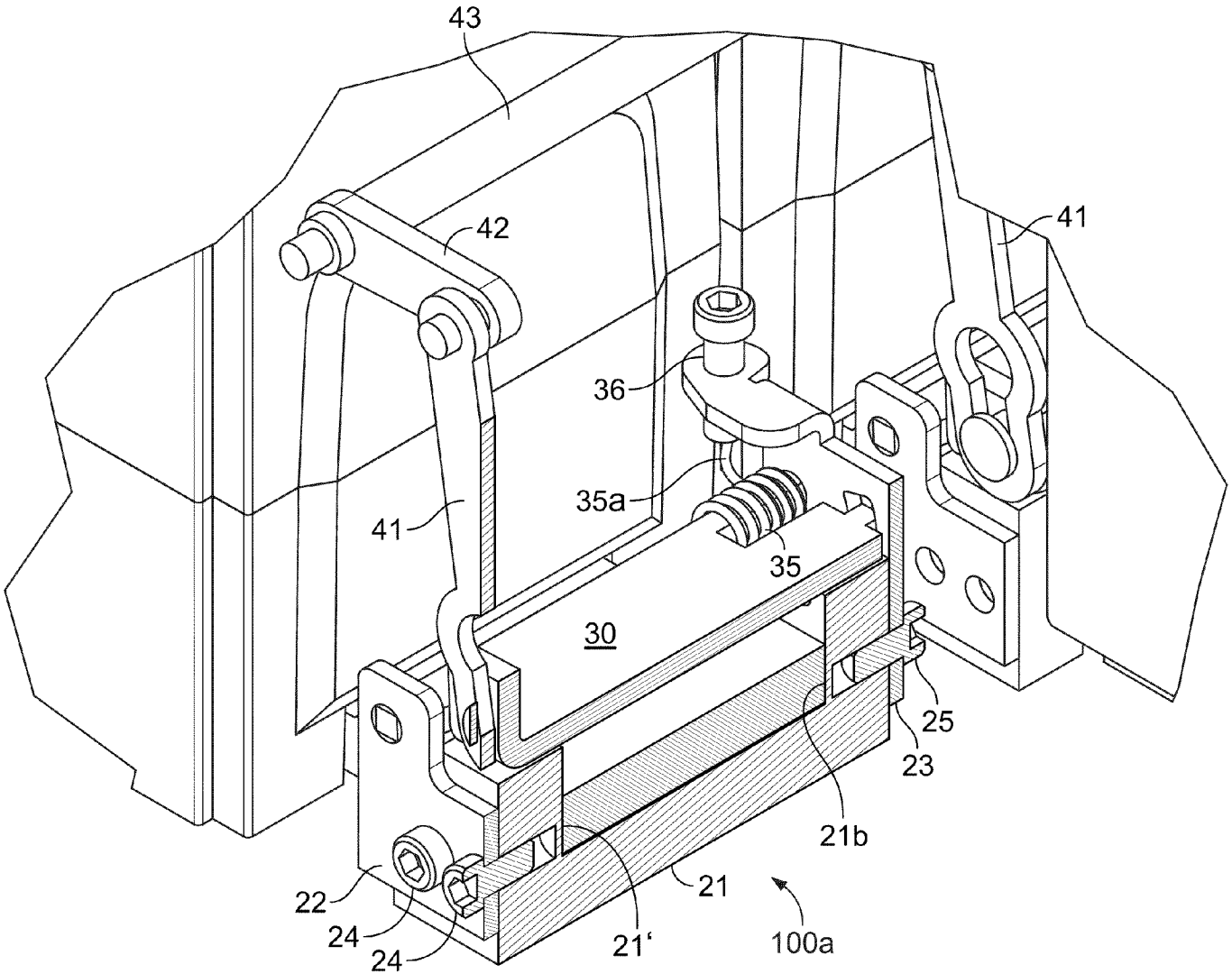
FIG. 5 is a sectional view of the structure shown in FIG. 3 sectioned along line 5-5 in FIG. 3.

To convert the circuit breaker from electronic actuation to mechanical actuation, an add-on module 20 is attached to one end of the basic mechanical structure 10. The module 20 bridges across the three output terminals 12*a*-12*c*, which are replacements for the input terminals normally used with the basic mechanical structure 10 of the illustrative host circuit breaker. The replacement terminals 12*a*-12*c* have increased lengths to accommodate the insertion of the module 20 between the basic mechanical structure 10 and the lugs 16*a*-16*c* used to attach power cables to the terminals. As can be seen in FIGS. 2 and 4, the extra length of each of the terminals 12*a*-12*c*, between the end wall of the basic mechanical structure 10 and the corresponding lug 16, is arched to allow the central portion of a stationary ferromagnetic element 21 to pass beneath the terminal.

The stationary ferromagnetic element 21 is part of an electromechanical transducer 100 that produces mechanical movement in response to a predetermined magnitude of electrical current in the corresponding terminal 12 to which the transducer is coupled. In the illustrated embodiment, the stationary ferromagnetic element 21 is U-shaped with the two legs 21' and 21" of the U extending upwardly past the side edges of the underlying terminal 12. Two end plates 22 and 23 are attached to the outer surfaces of the legs 21' and 21", respectively, with two pairs of screws 24 and 25. A magnetic flux is induced in the stationary ferromagnetic element 21 when electrical current passes through the corresponding terminal 12, and the strength of the magnetic flux varies as a function of the magnitude of the electrical current. For example, in the event of a short circuit, the current level in the terminal is very high and thus induces a large magnetic flux in the stationary ferromagnetic element 21. Three separate stationary ferromagnetic elements 21*a*-21*c* are coupled to the respective terminals 12*a*-12*c* to form three electromagnetic transducers 100*a*, 100*b* and 100*c*. The magnetic flux increases rapidly to a saturation value as the electrical current in the terminals 12*a*-12*c* increases.

Figure 6:
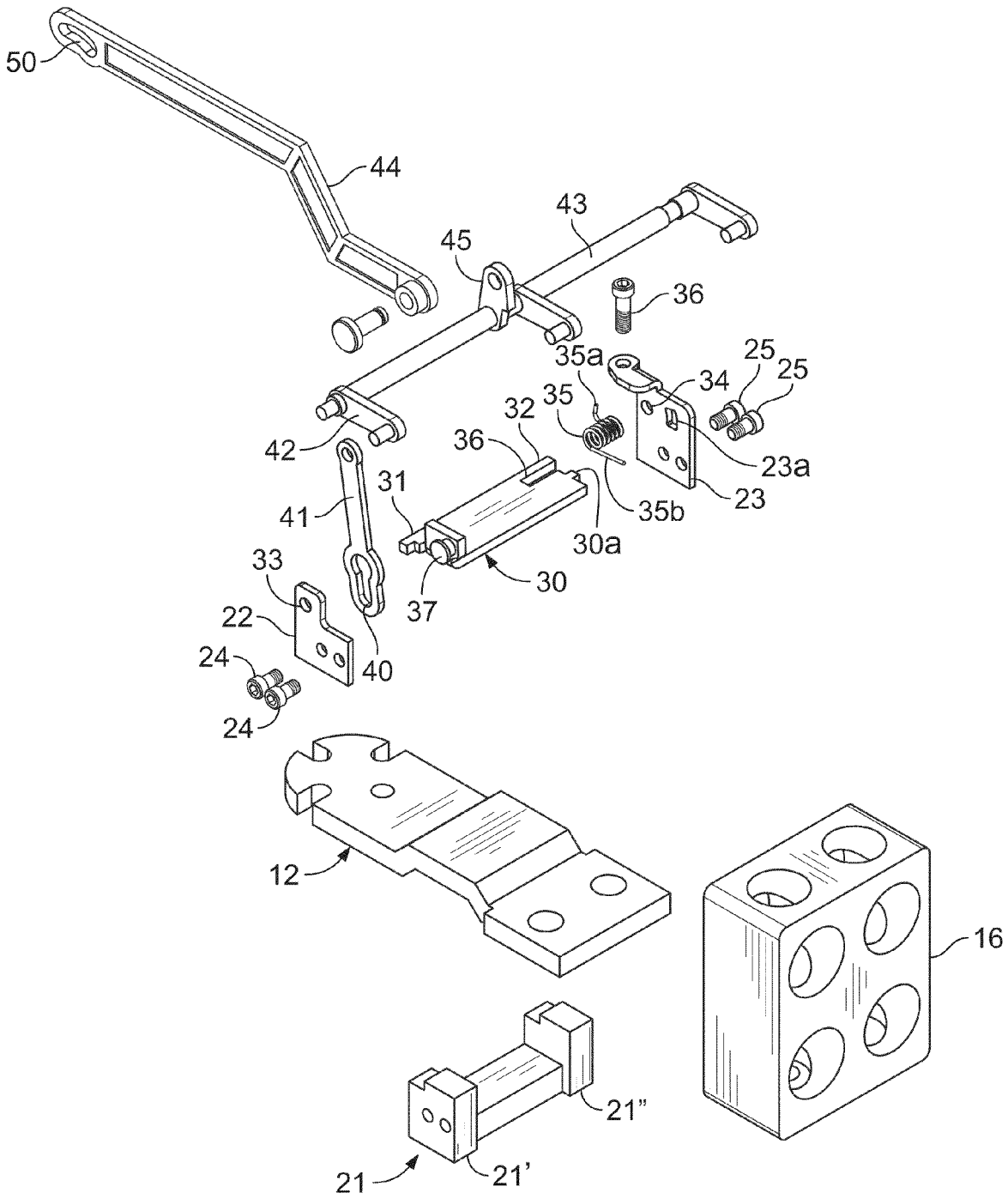
FIG. 6 is an exploded perspective of one of the electromechanical transducers and the mechanical actuator in the add-on module shown in FIG. 2.

Directly above the open end of each stationary ferromagnetic element 21, a movable rectangular ferromagnetic element 30 extends across the open end of the U and is pivotally mounted in the two end plates 22 and 23. Three separate movable ferromagnetic elements 30 are mounted above the respective stationary ferromagnetic elements 21*a*-21*c*. Each of the movable ferromagnetic elements 30 includes a pair of integral projections 31 and 32 (see FIG. 6) at opposite ends of one of the long edges of the movable element 30, and these projections 31 and 32 fit into mating holes 33 and 34 in the respective end plates 22 and 23 to allow pivoting movement of the element 30.

Each of the movable ferromagnetic elements 30 is biased upwardly by a separate torsion spring 35 that is slightly compressed by a calibration screw 36 engaging one end 35*a* of the spring 35. The other end 35*b* (see FIGS. 6-7C) of the spring 35 bears against the lower surface of the movable ferromagnetic element 30 to urge the free end of the movable ferromagnetic element 30 upwardly around the axis extending through the mounting holes 33 and 34. A slot 30*a* extends into the body of the ferromagnetic element 30 from the inner edge of the projection 32 to accommodate the spring 35, which is captured on the ferromagnetic element 30 by the end plate 23. When the current in the terminal increases to a predetermined threshold, the resulting magnetic flux in the stationary element 21 increases to a level that causes the free edge of the movable ferromagnetic element 30 to be drawn downwardly against the upward biasing force of the spring 35.

The calibration screw 36 permits manual adjustment of the resisting force of the biasing spring 35, thereby adjusting the predetermined magnitude of electrical current required to overcome the biasing force of the spring 35. As the calibration screw 36 is advanced downwardly against the end of the torsion spring 35, the upward spring force applied to the ferromagnetic element 30 is progressively increased because the amount of torque exerted by a torsion spring is proportional to the amount it is twisted. And increasing the spring force applied to the ferromagnetic element 30 increases the amount of current required to move the ferromagnetic element 30 and trip the breaker.

Figure 7A:
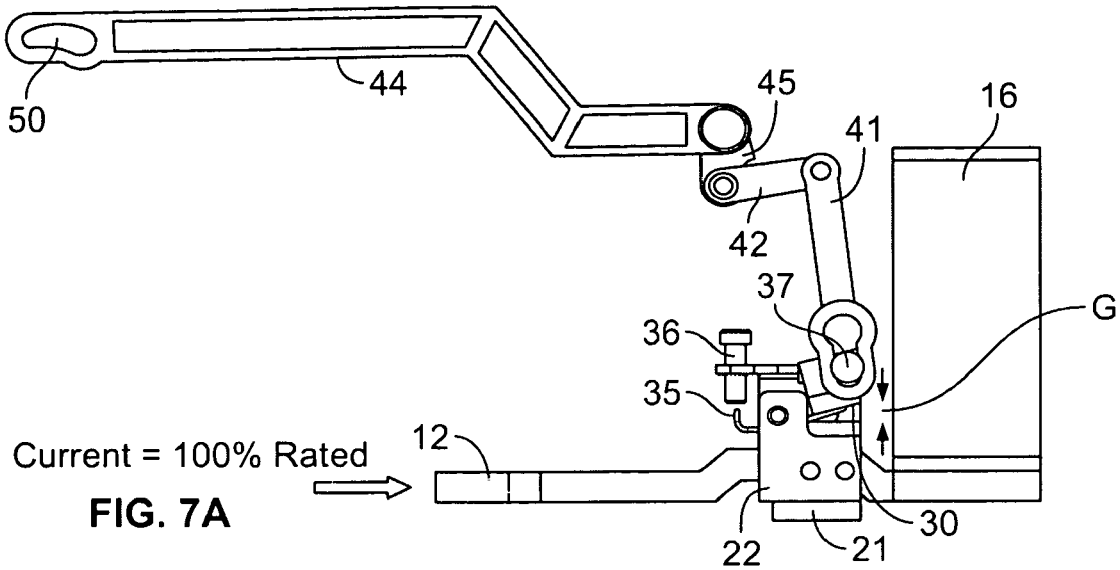
FIGS. 7A, 7B and 7C are side elevations of the add-on module of FIG. 2 in three different stages of operation.
Figure 7B:
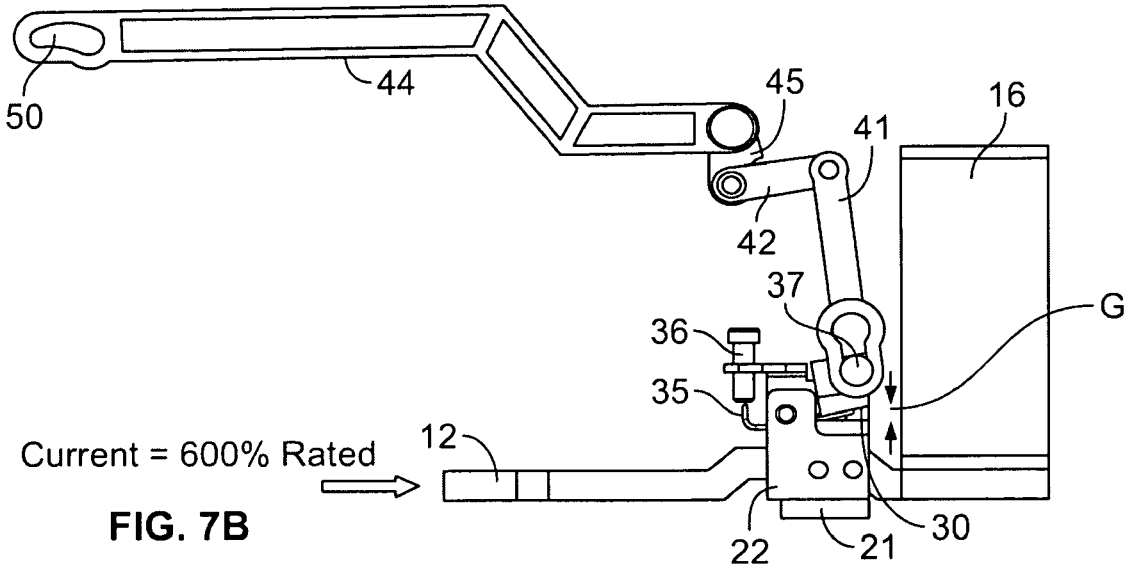
Figure 7C:
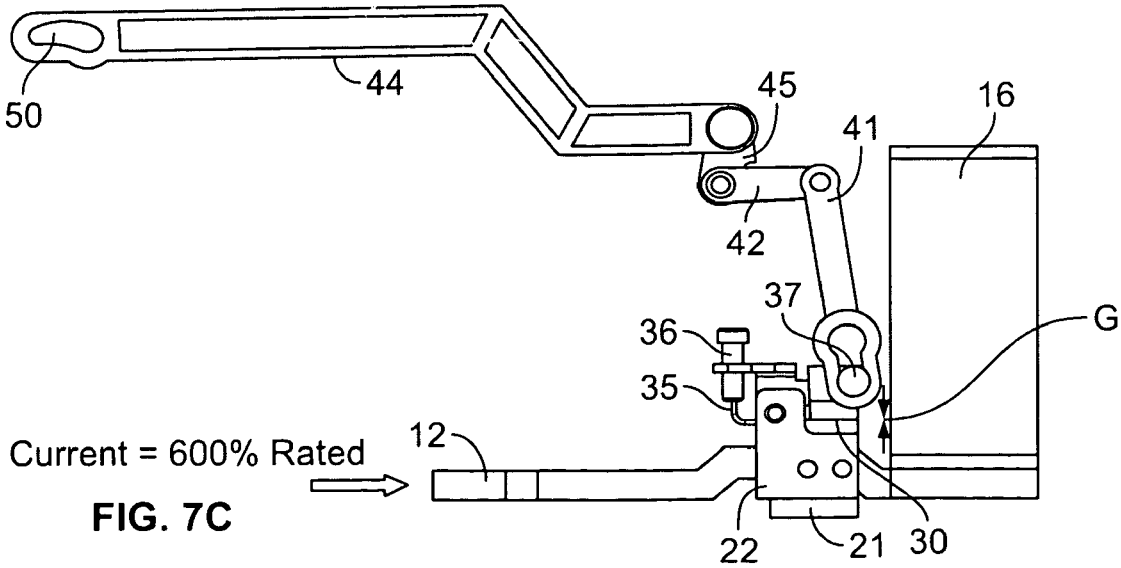

As can be seen in FIGS. 7A-7C, each movable ferromagnetic element 30 is biased toward its raised position, shown in FIG. 7A, by the torsion spring 35 mounted on the projection 32 of the element 30. This maximizes the air gap G between the lower surface of the movable ferromagnetic element 30 and the upper surfaces of the stationary ferromagnetic element 21. Upward movement of the element 30 is limited by engagement of an integral projection 30*a* with the upper end of a slot 23*a* in the end plate 23.

FIG. 7B illustrates the movable ferromagnetic element 30 beginning to pivot downwardly when the current passing through the terminal 12 reaches the threshold level. A pin 37 extending laterally from one end of the element 30 slides downwardly through a slot 40 in a link 41 until the pin 37 bottoms out at the lower end of the slot 40. Further downward movement of the movable ferromagnetic element 30 then pulls the link 41 downwardly, thereby pulling down one end of a link 42 attached to the upper end of the link 41. The other end of the link 42 is attached to a crossbar 43, which is rotated slightly (in a clockwise direction as viewed in FIG. 7B) by the movement of the link 42. This movement continues until the movable element 30 bottoms out on the upper surfaces of the stationary ferromagnetic element 21, as illustrated in FIG. 7C. Three separate links 41*a*-41*c* and 42*a*-42*c* are coupled to the respective movable ferromagnetic elements 30*a*-30*c*.

Rotational movement of the crossbar 43 is translated into linear movement of an elongated trip link 44 connected to the crossbar 43 by a short coupling link 45. The elongated trip link 44 extends across a major portion of the basic mechanical structure 10 and is attached at its far end to the same trip mechanism to which the solenoid armature is attached when an electronic actuator is used with the basic mechanical structure 10. Thus, movement of the elongated link 44 trips the host circuit breaker, in the same manner that movement of the solenoid armature trips the breaker with an electronic actuator.

The entire actuating mechanism between the movable ferromagnetic elements 30 and the trip mechanism of the host circuit breaker is preferably made of a non-conductive material, such as a polymeric material, to avoid any undesired induced currents or magnetic fluxes. The use of a polymeric material also permits a substantial portion of the actuator to be molded as a single piece, e.g., the crossbar 43 and the links 42, 44 and 45.

Figure 8:
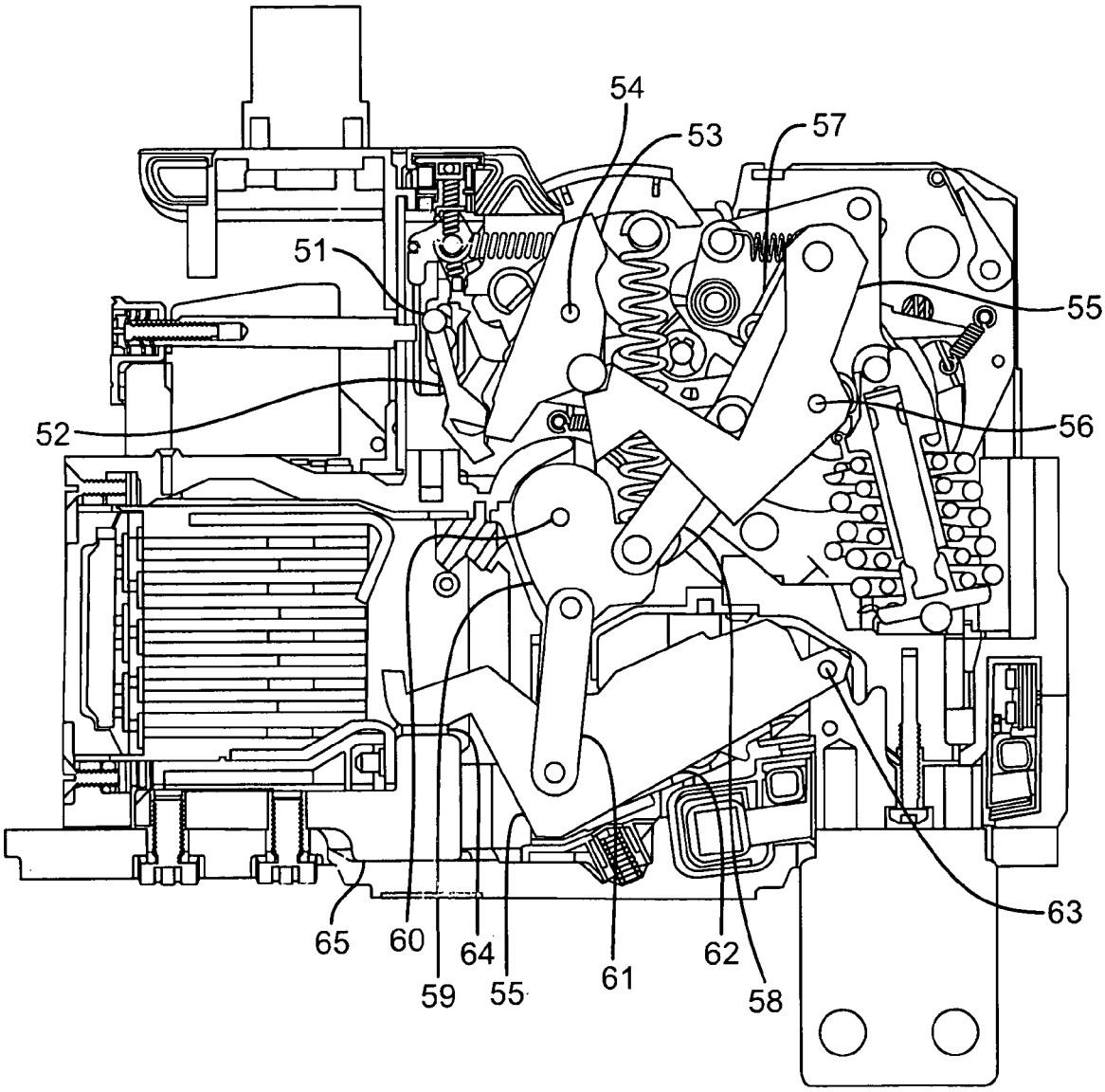
FIG. 8 is a side elevation of the basic mechanical structure of a host multi-pole circuit breaker operated by the actuator of the add-on module shown in FIG. 2.
Figure 9:
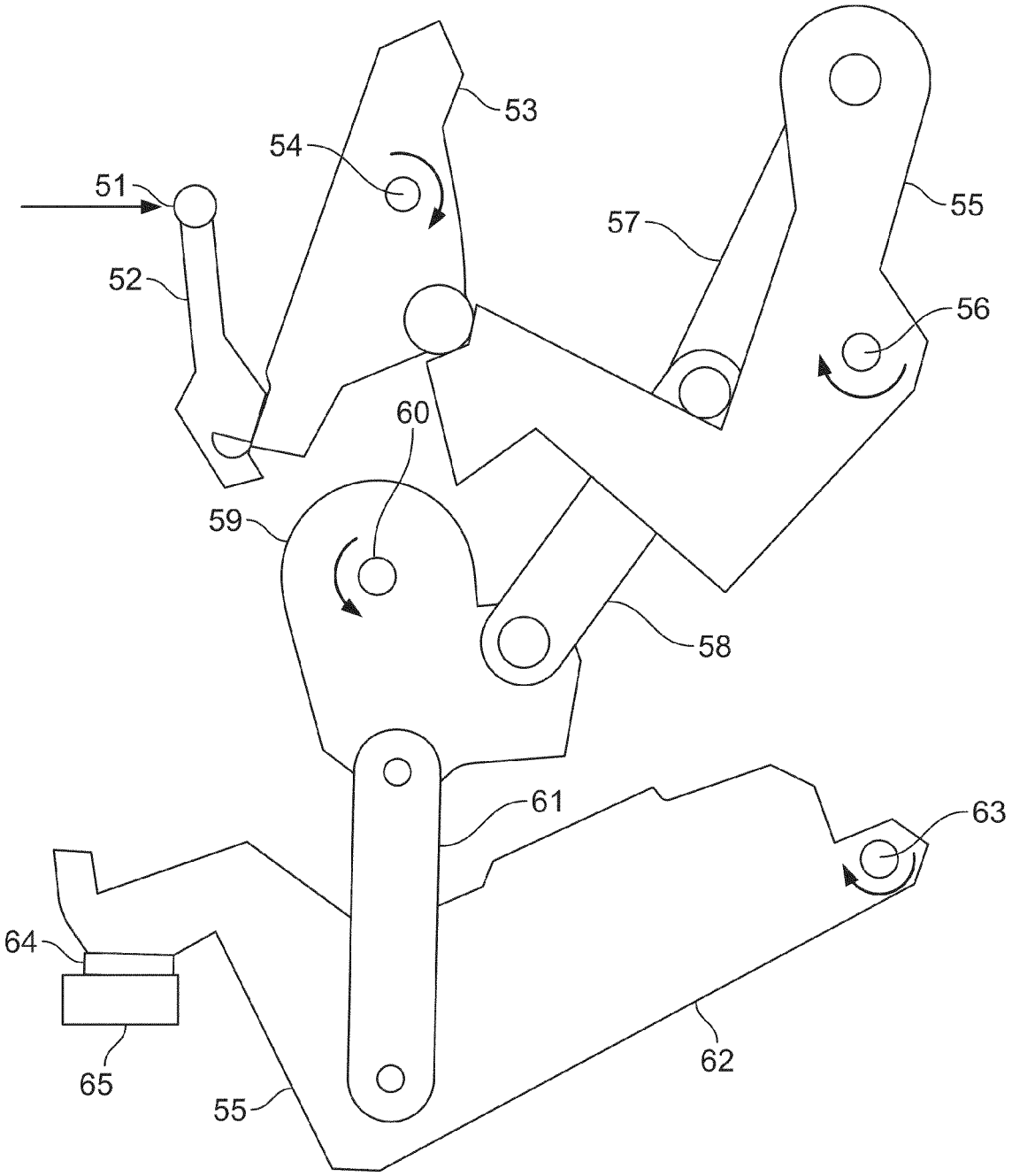
FIGS. 9 and 10 are side elevations of the main components of the basic mechanical structure shown in FIG. 8, in two different stages of operation.
Figure 10:
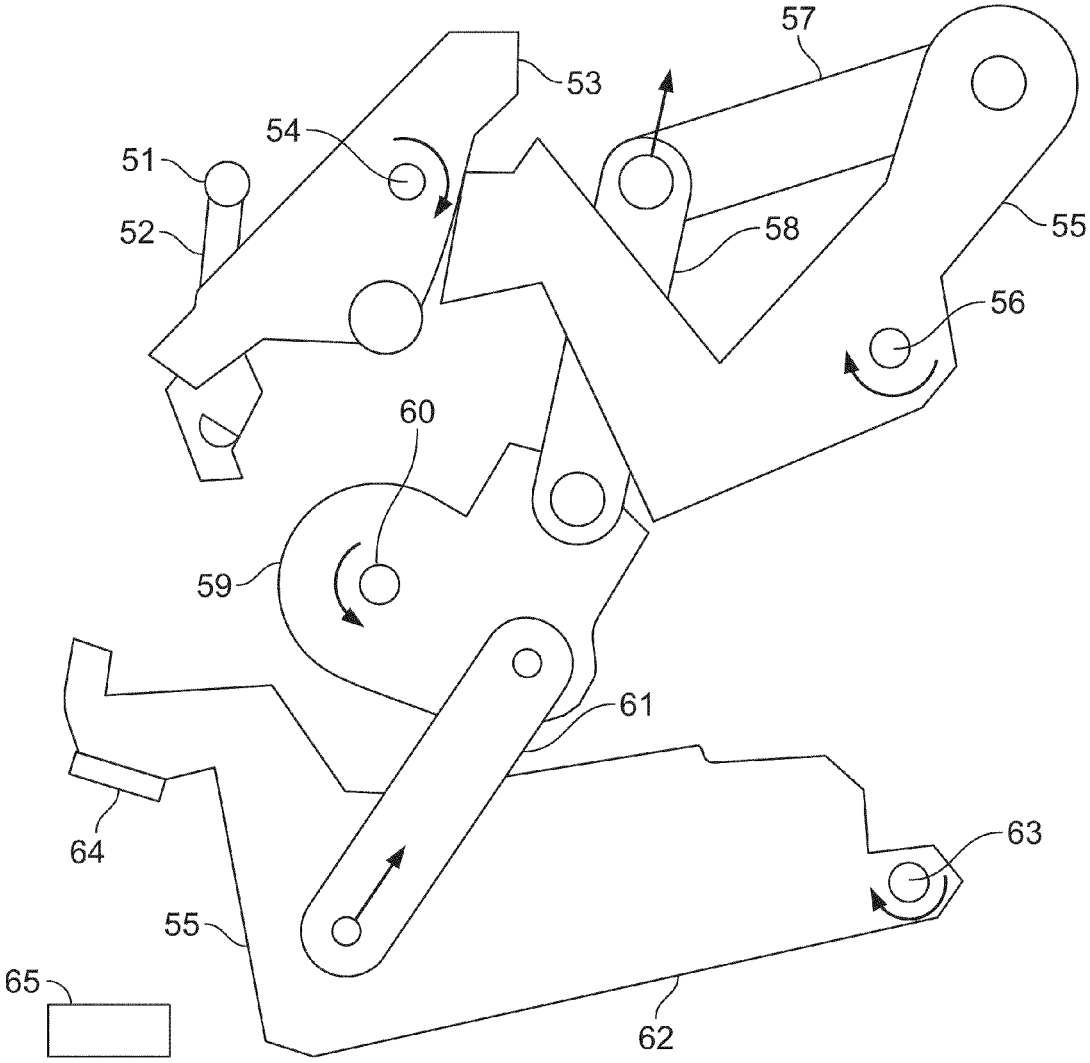

FIGS. 8-10 illustrate the main components of the basic mechanical structure 10 that opens the contacts in the host circuit breaker in response to the mechanical movement of the elongated trip link 44. FIGS. 8 and 9 illustrate the basic mechanical structure in the ON condition, i.e., with the breaker contacts 64, 65 closed, and FIG. 10 illustrates the same structure in the TRIPPED condition, i.e., with the breaker contacts 64, 65 open. Portions of this basic mechanical structure are described and illustrated in U.S. Pat. No. 6,337,449 assigned to the assignee of the present invention.

The distal end of the link 44 forms an elongated slot 50 that receives a laterally projecting pin 51 on the end of a latch bar 52 in the host breaker. The latch bar 52 pivots when the pin 51 is pulled toward the add-on module by movement of the link 44 to the left as viewed in FIG. 7-9. This pivoting movement of the latch bar 52 releases a latch plate 53 that is spring-biased to pivot in a clockwise direction (as viewed in FIG. 9) around an axis 54, which in turn allows a spring-biased hook plate 55 to pivot in a clockwise direction (as viewed in FIG. 9) around an axis 56. The pivoting movement of the hook plate 55 causes an upper link 57 attached to the upper end of the hook plate to pivot in a clockwise direction (as viewed in FIG. 9) with the hook plate, thereby raising a lower link 58 that connects the lower end of the upper link to a pole bar 59. The upward movement of the lower link 58 turns the pole bar 59 around an axis 60 in a counterclockwise direction (as viewed in FIG. 9), thereby raising a pole link 61. The upward movement of the pole link 61 pivots a pole 62 in a clockwise direction (as viewed in FIG. 9) around an axis 63. The pole 62 carries the movable contact 64, and the pivoting clockwise movement of the pole 62 raises the contact 65 to separate it from a mating stationary contact 65. Thus, the mechanical movement of the trip 44 is translated into pivoting movement of the movable contact 64 away from the stationary contact 65 in each of the three poles, thereby opening the breaker.

The add-on module described above permits the electronic sensing and trip-actuating portions of an electronic multipole circuit breaker to be easily replaced with an electromechanical sensing and trip-actuating device suitable for use with AC and DC power systems. The basic mechanical structure of the host circuit breaker used with the electronic actuator is still used with the add-on module, thus taking advantage of the economics of mass production of that basic mechanical structure. The add-on module itself can be manufactured and assembled at a relatively low cost because it has a small number of parts that are easily assembled.

Figure 11:
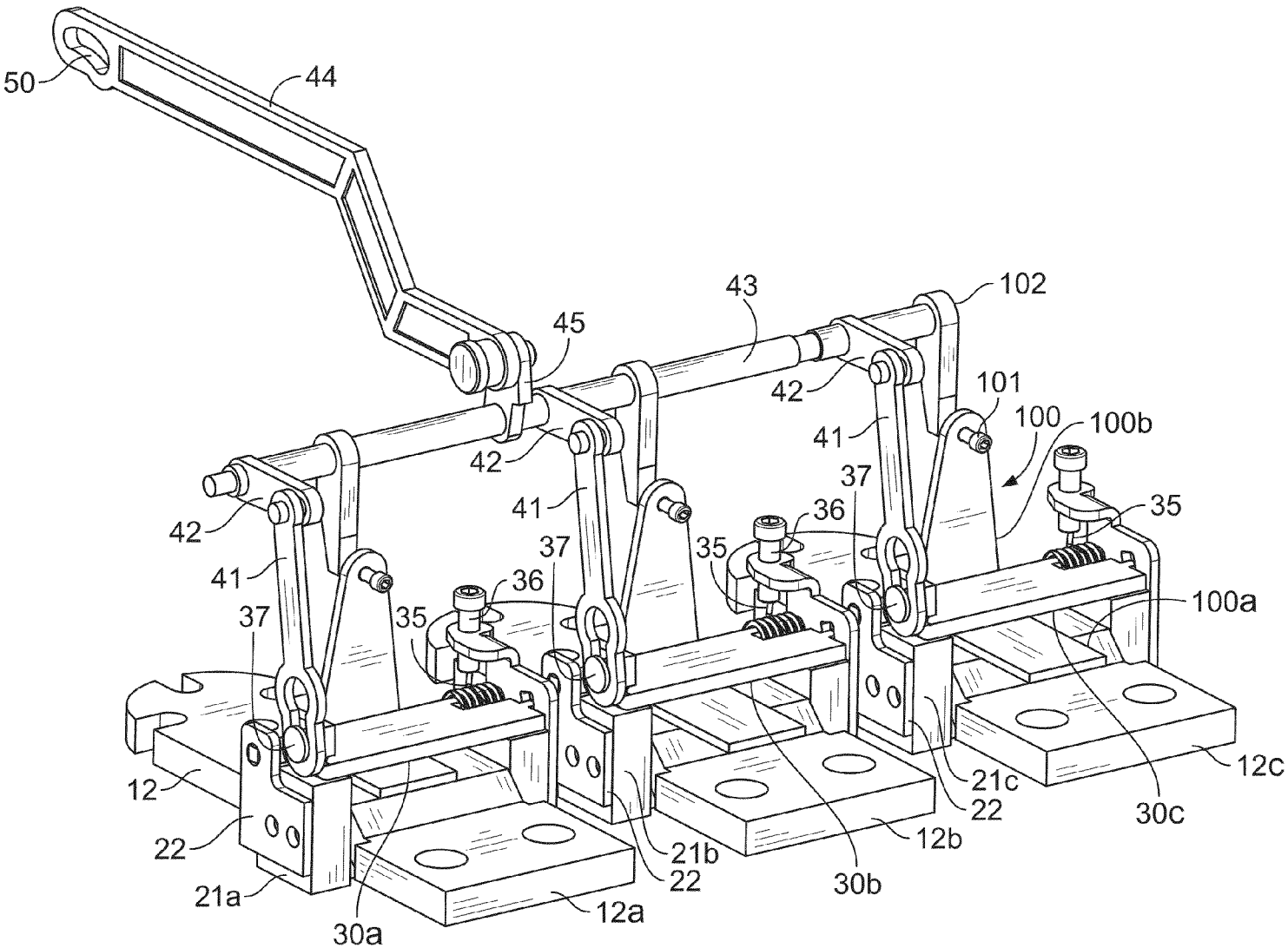
FIG. 11 is a perspective view of a modified add-on module that includes a second type of electromechanical transducer utilizing a bimetallic element.
Figure 12A:
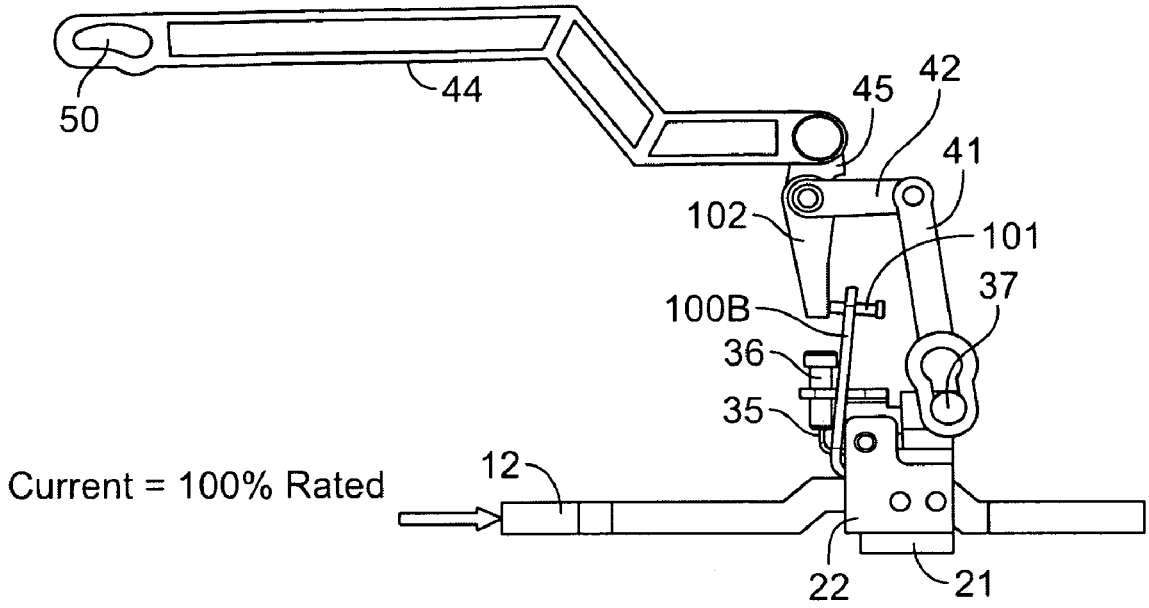
FIGS. 12A and 12B are side elevations of the structure shown in FIG. 11 in two different stages of operation.
Figure 12B:
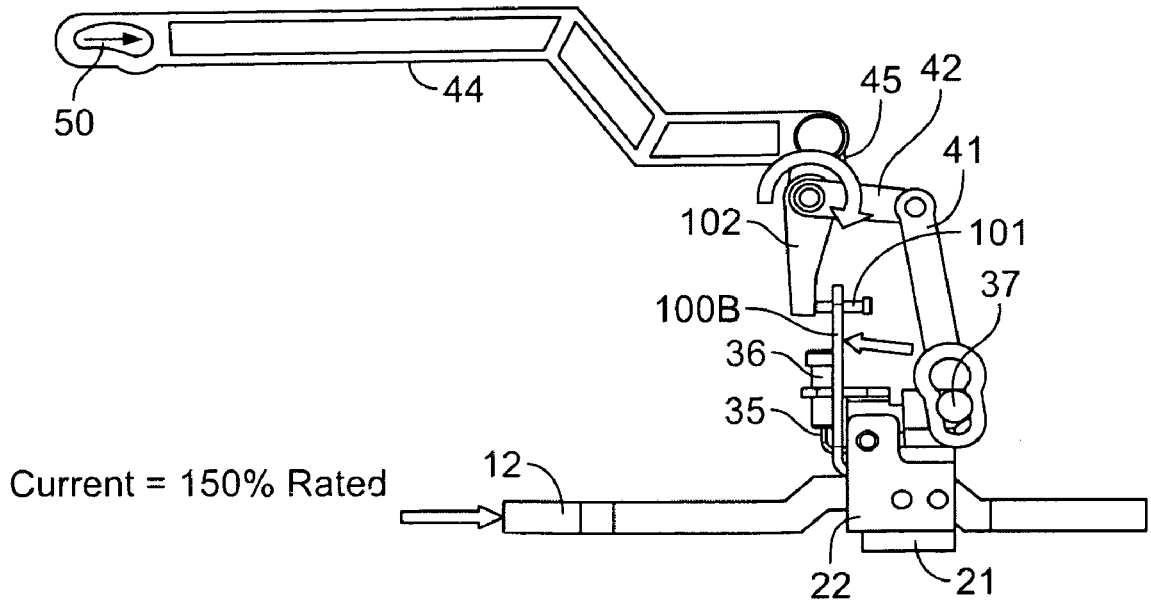

FIGS. 11, 12A and 12B illustrate a modified add-on module for effecting a thermal trip. In this modified embodiment, each of the output terminals 12*a*-12*c* is coupled to a second electromechanical transducer that actuates the trip mechanism by turning the crossbar 43 in response to a temperature change produced by an electrical current above a predetermined level. As further discussed below, each transducer includes a temperature-responsive thermomechanical element, such as a bimetal, that is heated by the electrical current in the terminal and produces mechanical movement that is related to the temperature of the temperature responsive element.

In the illustrated embodiment, the temperature-responsive elements are three L-shaped bimetallic elements 100 attached to the upper surfaces of the respective terminals 12*a*-12*c*. One leg 100B of each L-shaped bimetallic element 100 extends upwardly away from the corresponding terminal 12, with the free end of that leg 100B carrying a screw 101 that engages a link 102 attached to the crossbar 43. As the bimetal is heated, the leg 100B bows because of the differential thermal expansion of the two different metals. This bowing deflects the free end of the leg 100B and its screw 101 against the link 102, thereby causing rotational displacement of the crossbar 43. As already described, rotational movement of the crossbar 43 is translated into linear movement of an elongated link 44 to actuate the trip mechanism in the host breaker. The screw 101 can be adjusted in relation to the link 102 to change the amount of bowing of the bimetallic element 100 required to effect a trip. It will be appreciated that either the transducers utilizing the bimetallic elements 100 or the transducers utilizing the ferromagnetic elements 21 and 30 may move the crossbar independently of each other to cause a trip.

Figure 13:
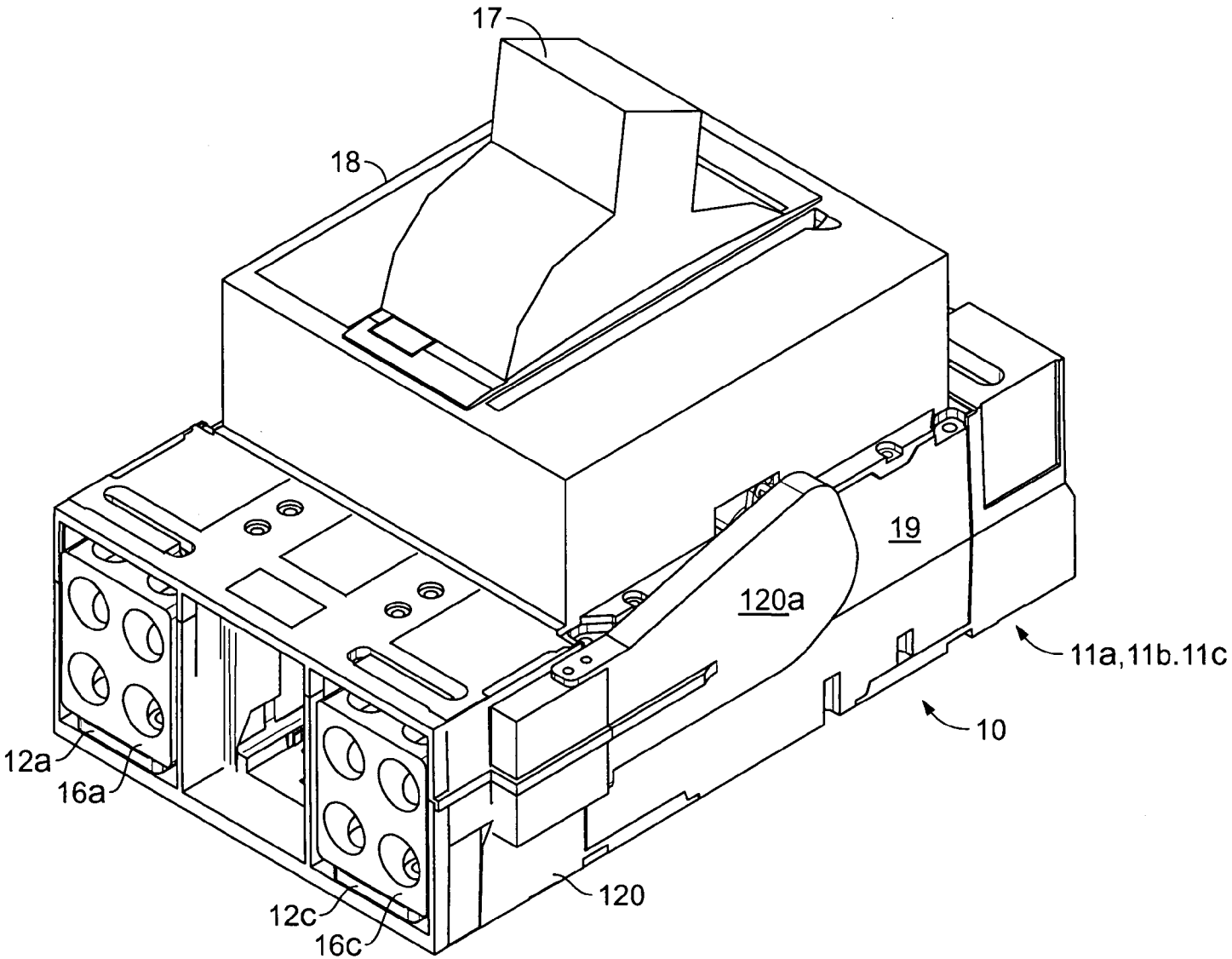
FIG. 13 is a perspective view of a multiple-pole circuit breaker equipped with an add-on module that includes a mechanical actuator for the trip mechanism in the basic mechanical structure of the breaker.
Figure 14:
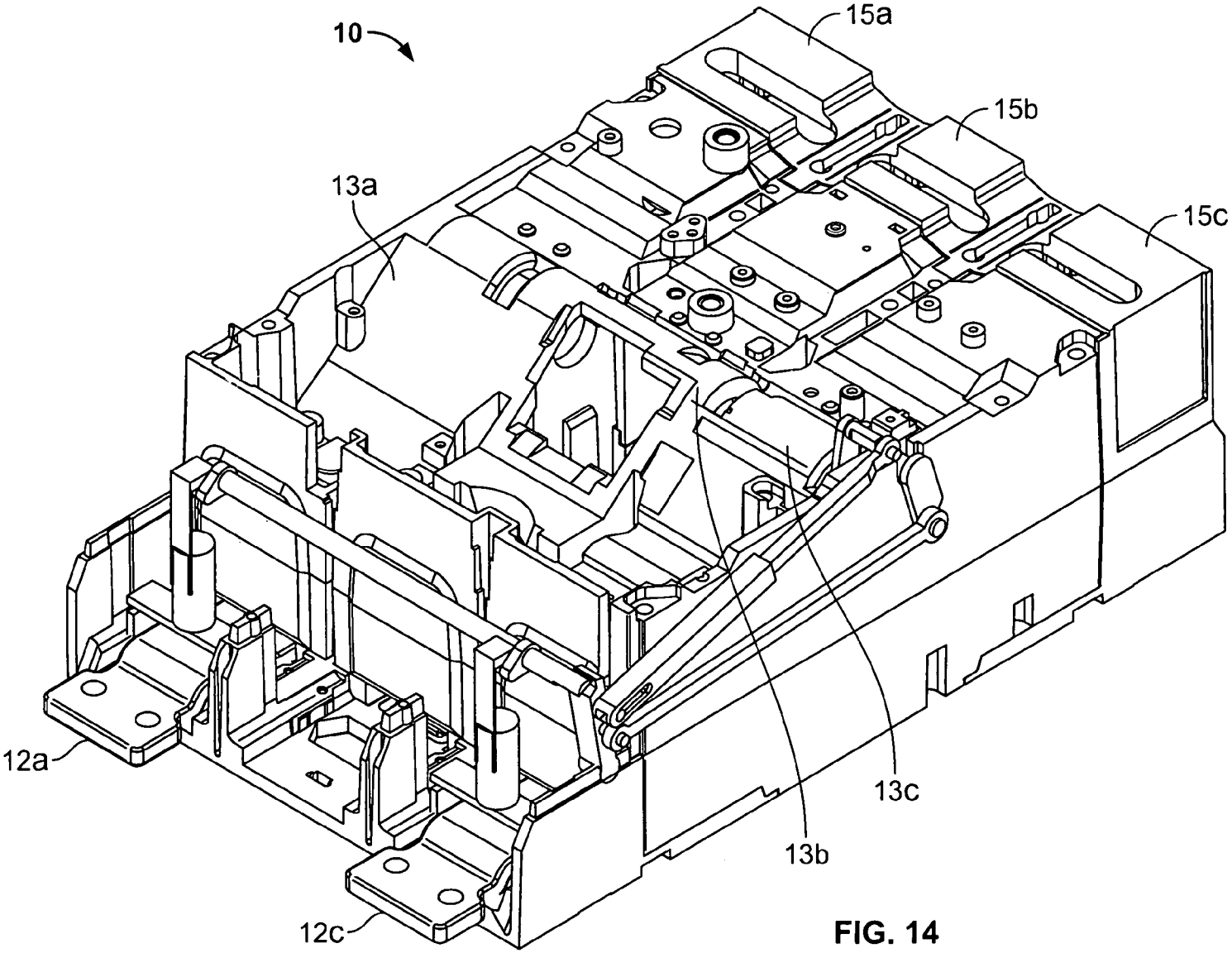
FIG. 14 is the same perspective view as shown in FIG. 13 with the manual toggle and the housings removed.

FIGS. 13 and 14 illustrate another modified add-on module 120 is attached to one end of the basic mechanical structure 10 and includes an extension 120*a* (see FIG. 13) that extends along one side of the host breaker housing 19 and contains links to the trip and reset mechanisms in the host breaker. As in the module 20 described above, stationary ferromagnetic elements 121*a*-121*c* form parts of electromechanical transducers that produce mechanical movement in response to a predetermined magnitude of electrical current in the corresponding terminal 12 to which the transducer is coupled. In the illustrated embodiment, each stationary ferromagnetic element 121 is U-shaped with the two legs 121' and 121" of the U extending upwardly past the side edges of the underlying terminal 12. A magnetic flux is induced in the stationary ferromagnetic element 121 when electrical current passes through the corresponding terminal 12, and the strength of the magnetic flux varies as a function of the magnitude of the electrical current. For example, in the event of a short circuit, the current level in the terminal is very high and thus induces a large magnetic flux in the stationary ferromagnetic element 121. The magnetic flux increases rapidly to a saturation value as the electrical current in the terminals 12*a*-12*c* increases.

Figure 15:
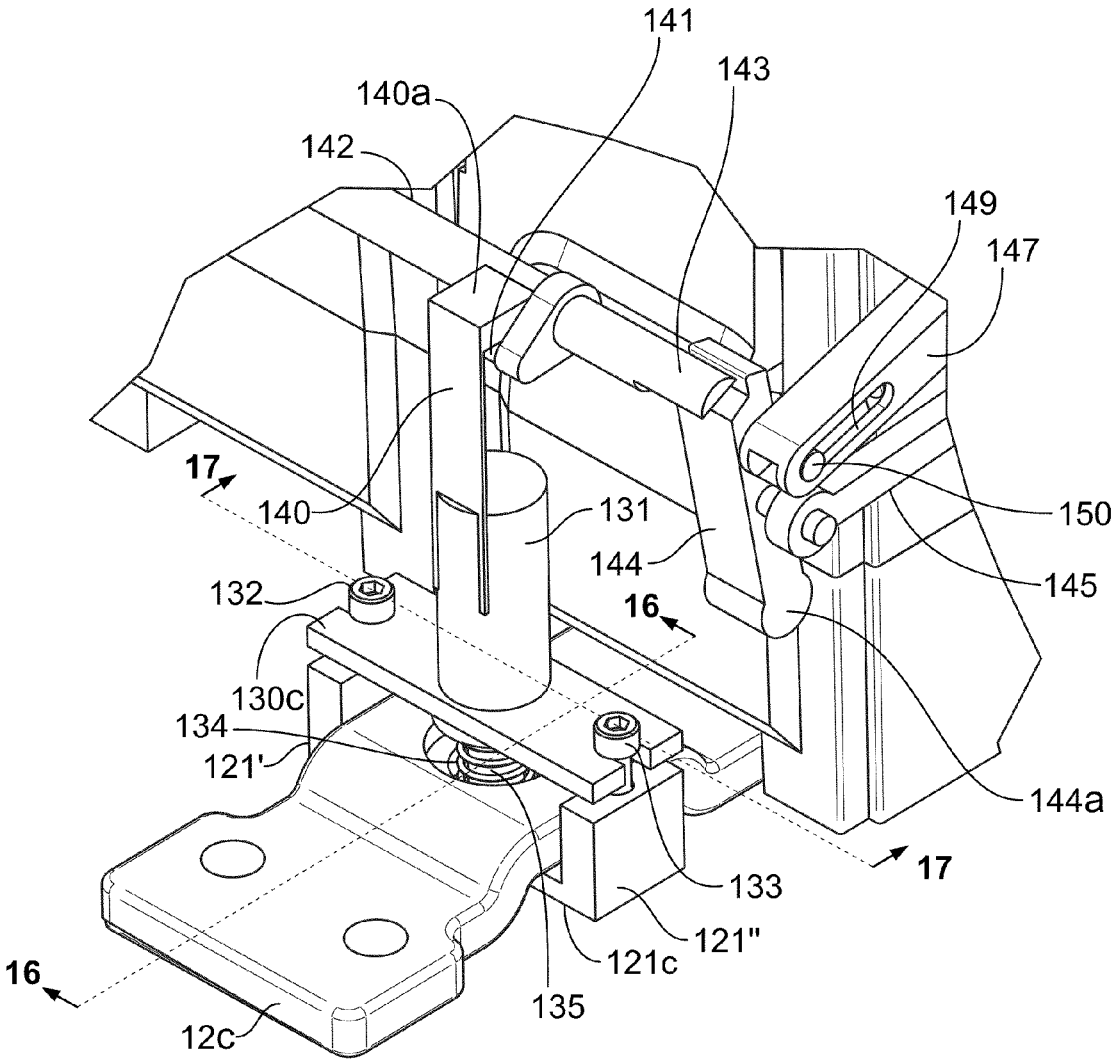
FIG. 15 is an enlarged perspective view of the lower front corner of the structure shown in FIG. 14.
Figure 18:
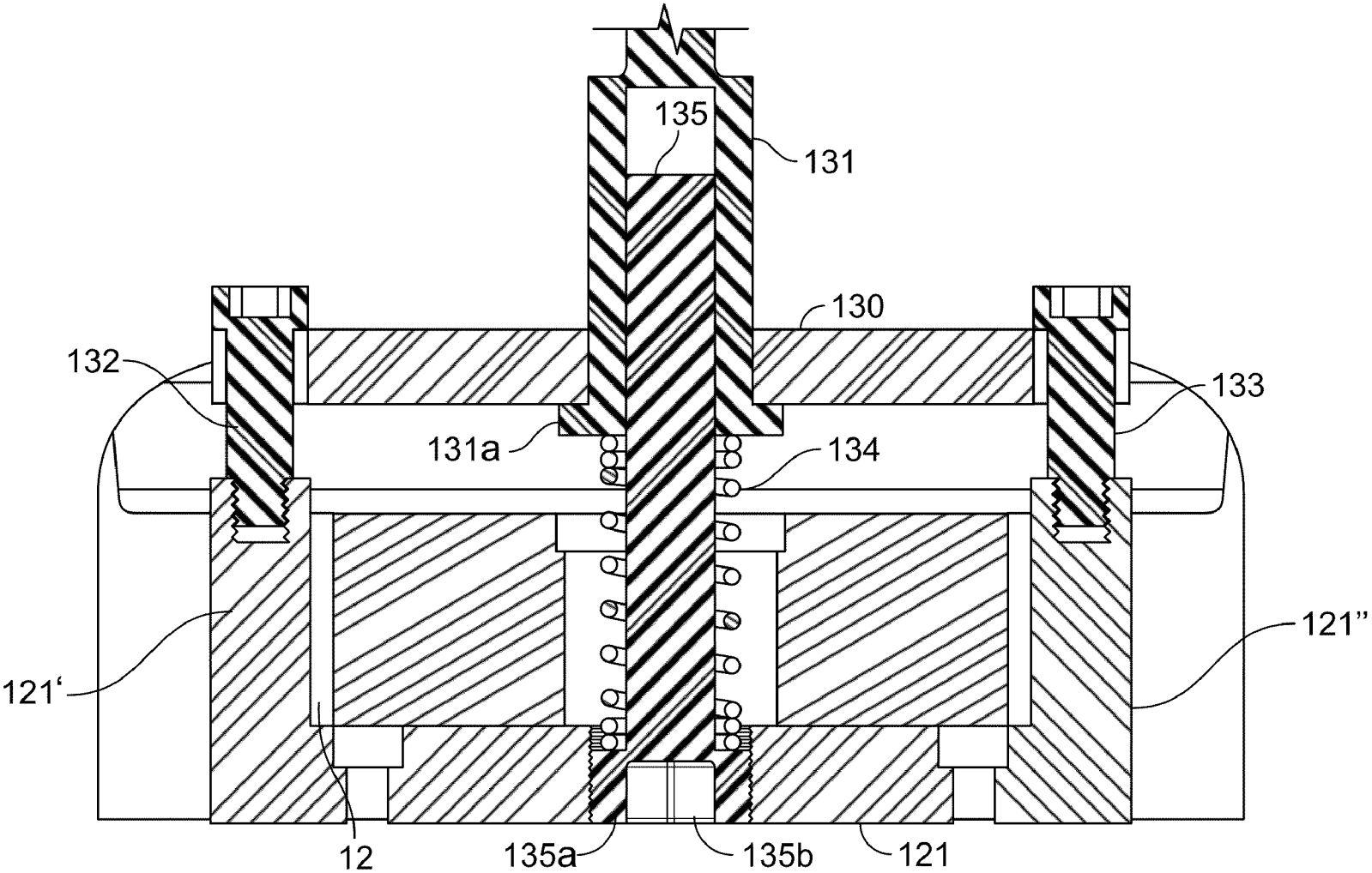
FIG. 18 is an enlarged elevation view of the section taken along line 17-17 in FIG. 15.

Directly above the open end of each U-shaped stationary ferromagnetic element 121, a movable rectangular ferromagnetic element 130 extends across the open end of the U and is slidably mounted for vertical movement on a central cylinder 131 and a pair of end posts 132 and 133 attached to the two legs 121' and 121" of the stationary element 121 (see FIG. 15). Three separate movable ferromagnetic elements 130 are mounted above the respective stationary ferromagnetic elements 121*a*-121*c*. Each of the movable ferromagnetic elements 130 is biased upwardly by a separate compressed coil spring 134 that is captured between the lower end of the cylinder 131 and the base 135*a* (FIG. 18) of a post 135 that extends upwardly into the cylinder 131. The spring 134 urges the cylinder 131 upwardly so that a flange 131*a* on the lower end of the cylinder 131 applies an upward biasing force to the lower surface of the movable ferromagnetic element 130. When the current in the terminal 12 increases to a predetermined threshold, the resulting magnetic flux in the stationary element 121 increases to a level that causes the movable ferromagnetic element 130 to be drawn downwardly against the upward biasing force of the spring 134.

The base 135*a* of the post 135 is threaded into the base of the stationary ferromagnetic element 121 and forms a downwardly opening socket 135*b* that can be used to advance or retract the post 135 to adjust the degree of compression of the spring 134, thereby adjusting the upward biasing force exerted by the spring 134 on the movable ferromagnetic element 130. Increasing the spring force applied to the ferromagnetic element 130 increases the amount of current required to move the ferromagnetic element 130 and trip the breaker. Conversely, decreasing the spring force applied to the ferromagnetic element 130 decreases the amount of current required to move the ferromagnetic element 130 and trip the breaker.

Figure 16:
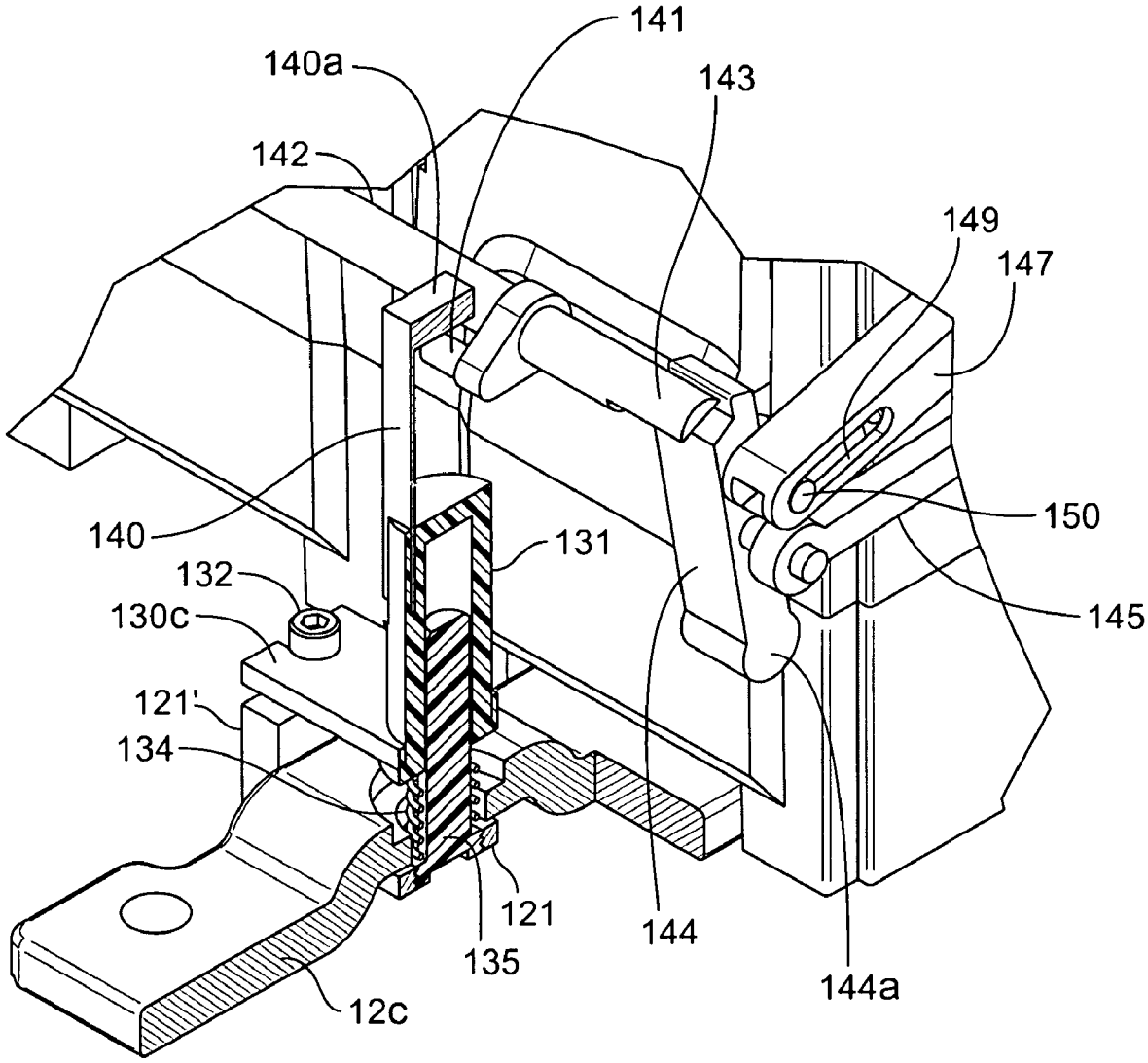
FIG. 16 is a sectional view of the structure shown in FIG. 15 taken along line 16-16 in FIG. 15.
Figure 17:
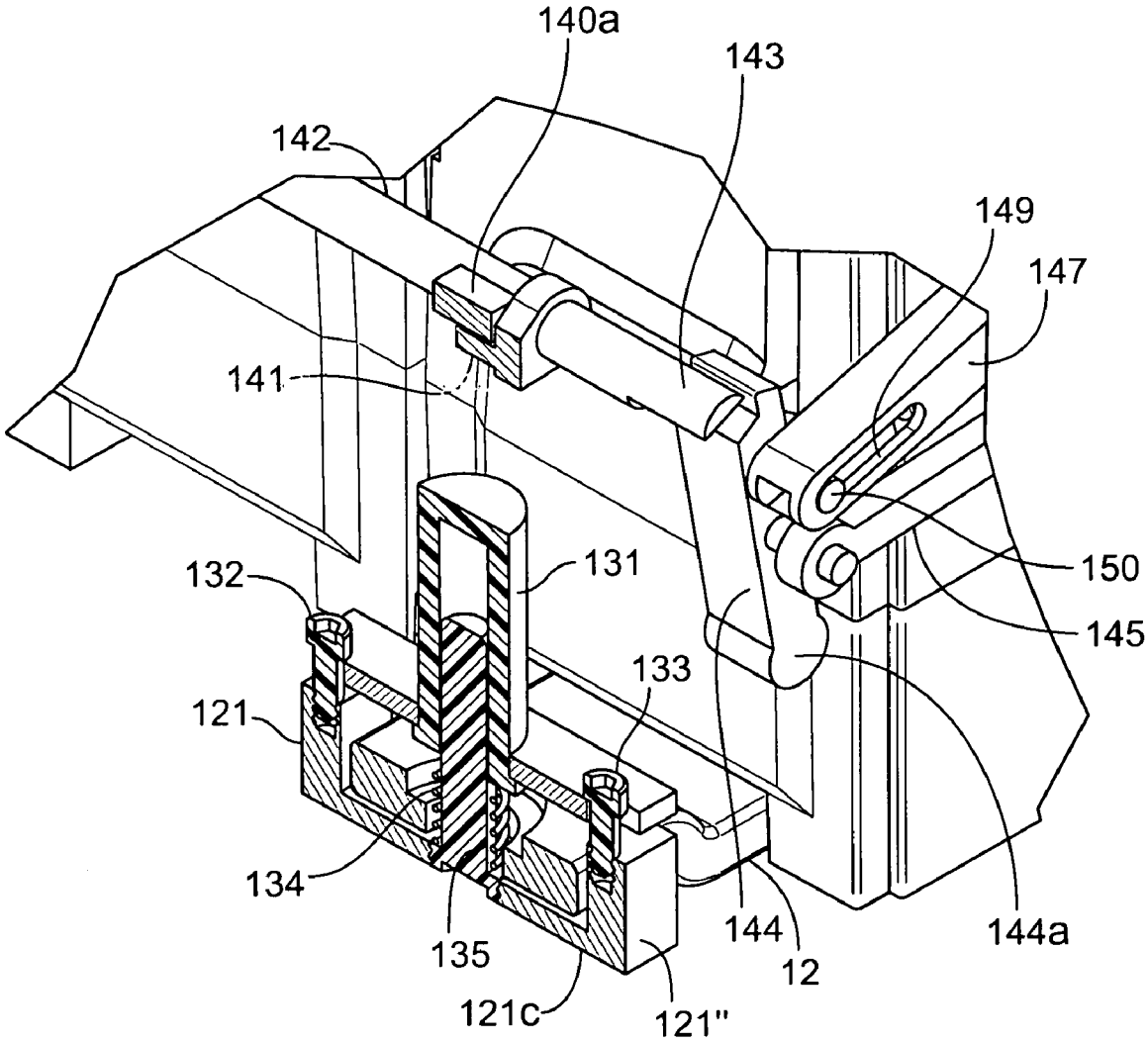
FIG. 17 is a sectional view of the structure shown in FIG. 15 taken along line 17-17 in FIG. 15.

Extending upwardly from the cylinder 131 is a rigid strip 140 that terminates in a flange 140*a* that cantilevers over and engages a pin 141 that is an integral part of a crossbar 142. The pin 141 is biased upwardly against the lower surface of the flange 140*a* by a coil spring (not shown) that biases the crossbar 142 in a clockwise direction (as viewed in FIGS. 15-17). The right-hand end of the crossbar 142 is cut out to form a trip latch 143 that cooperates with a cutout in a hook link 144. As described in detail below, the hook link 144 interacts both with a trip link 145 that is connected to a tripping lever 145*a* coupled to the trip mechanism in the host breaker, and with a cylinder 147 that is connected to the reset mechanism in the host breaker.

Figure 19:
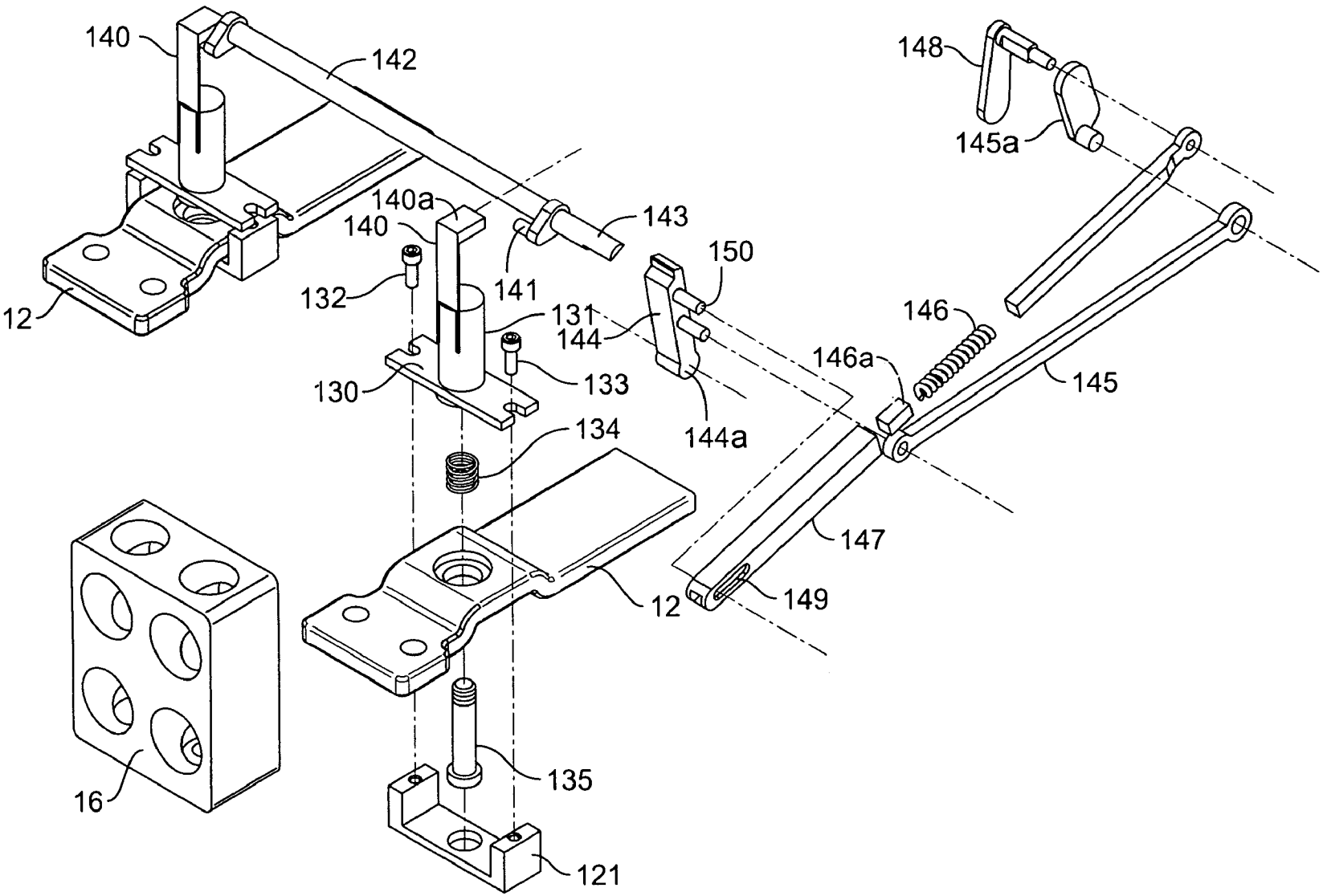
FIG. 19 is an exploded perspective of one of the electromechanical transducers and the mechanical actuator, reset and charging mechanism in the add-on module shown in FIG. 14.

FIGS. 20A-20E and 21A-21E illustrate how the vertical movement of one or more of the movable ferromagnetic elements 130 is utilized to mechanically trip the host circuit breaker (also see FIG. 19).

Figure 20A:
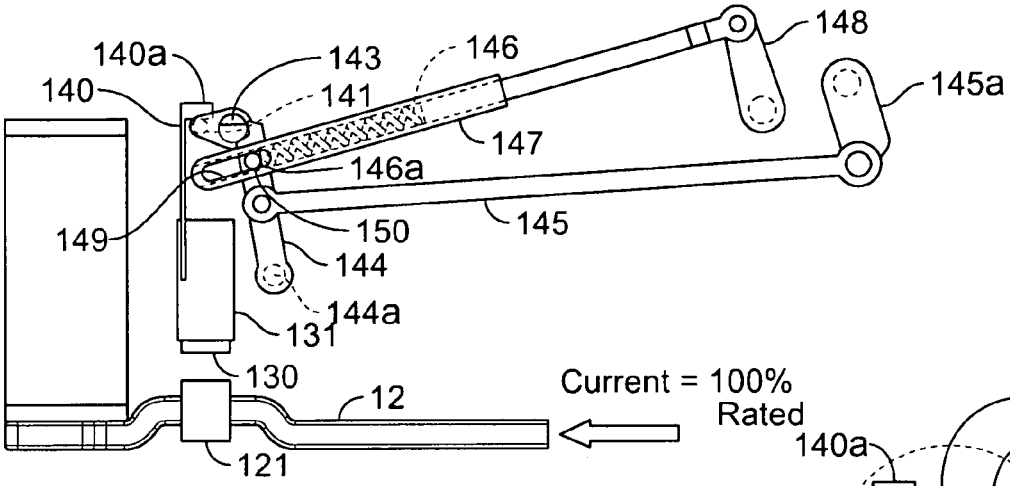
FIGS. 20A through 20E are side elevations of the add-on module of FIGS. 14-19 in five different stages of operation.
Figure 21A:
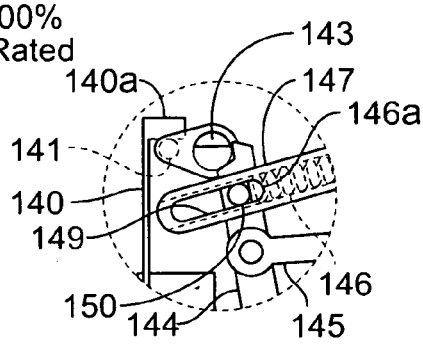
FIGS. 21A through 21E are enlarged side elevations of portions of FIGS. 20A-20E, respectively.
Figure 20B:
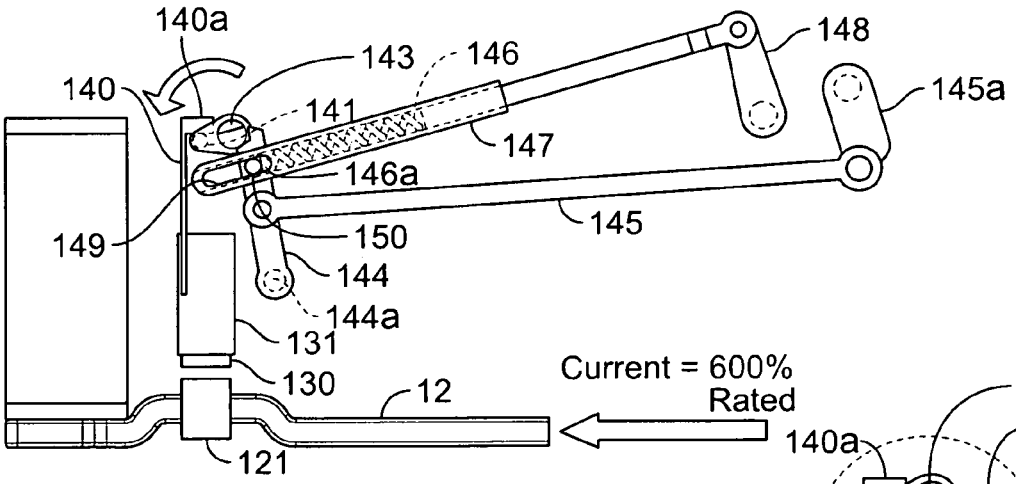

FIG. 20A illustrates the movable ferromagnetic element 130 in its fully raised position, with the trip link 45 of the add-on module latched in its reset, untripped position. FIG. 20B shows the ferromagnetic element 130 in its fully lowered position, with the trip link 45 unlatched but still in its reset, untripped position. As the ferromagnetic element 130 moves downwardly, from the position shown in FIG. 20A to the position shown in FIG. 20B, the cylinder 131 and a link 140 attached to the cylinder 131 also move downwardly. The flange 140*a* on the upper end of the link 140 extends laterally over a pin 141 attached to a crossbar 142. Thus, as element 130 is drawn downwardly, the flange 140*a* draws the pin 141 downwardly, thereby rotating the crossbar 142 slightly (in a counterclockwise direction as viewed in FIG. 20B). This rotational movement of the crossbar 142 turns a trip latch 143 formed by a cutout in the right-hand end of the crossbar 142 (as viewed in FIG. 20B). Before the trip latch 143 is turned, i.e., in the latched position shown in FIG. 20A, the trip latch engages a notched upper end of the hook link 144 pivotally attached to the end of a trip link 145.

Figure 21B:
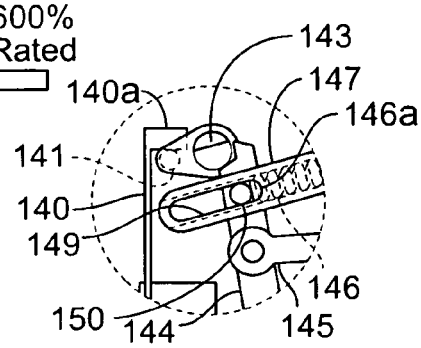
Figure 21C:
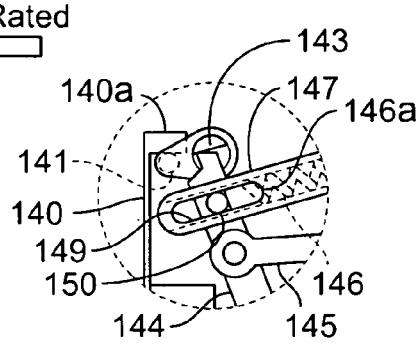

When the crossbar 142 is rotated to the position shown in FIGS. 20B and 21B, the trip latch 143 releases the hook link 144, and an energy storage spring 146 expands inside the cylinder 147 that is coupled to a charging and reset lever 148 in the host breaker. A slot 149 is formed in the left-hand end portion of the cylinder 147 for receiving a pin 150 projecting laterally from the hook link 144. Expansion of the spring 146 advances a small piston 146*a* to push the pin 150 and thus pivot the hook link 144, in counterclockwise direction (as viewed in FIG. 20C) around its axis 144*a*, to the position shown in FIGS. 20C and 21C. This pivoting movement of the hook link 144 pulls the trip link 145 to the left (as viewed in FIGS. 20C and 21C), which in turn causes pivoting movement of a tripping lever 145*a* attached to the right-hand end of the trip link 145 in a clockwise direction (as viewed in FIGS. 20C and 21C). Movement of the tripping lever 145*a* in the clockwise direction actuates the trip mechanism in the host breaker to open the breaker contacts.

The tripping lever 45*a* is attached to the same trip mechanism to which the solenoid armature is attached when an electronic actuator is used with the basic mechanical structure 10 of the host breaker. Thus, clockwise movement of the tripping lever 45*a* trips the host circuit breaker in the same manner that movement of the solenoid armature trips the breaker with an electronic actuator.

Figure 20C:
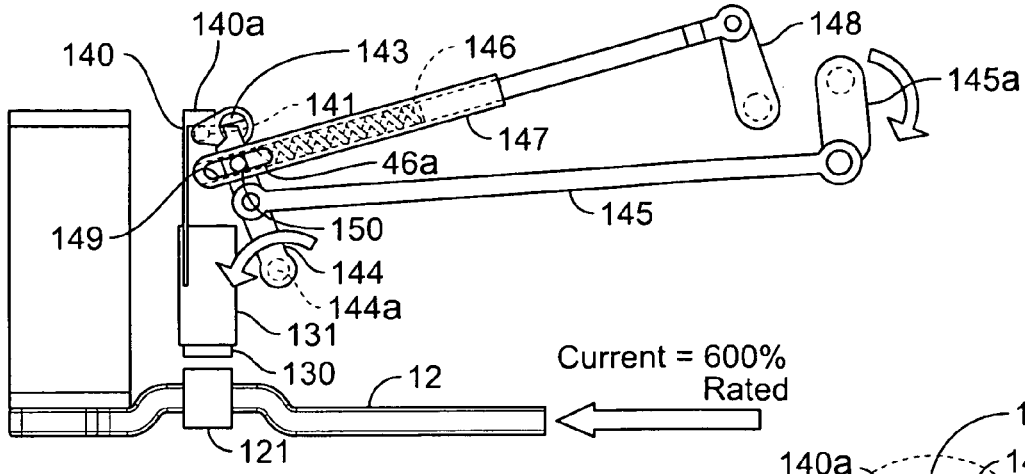
Figure 20D:
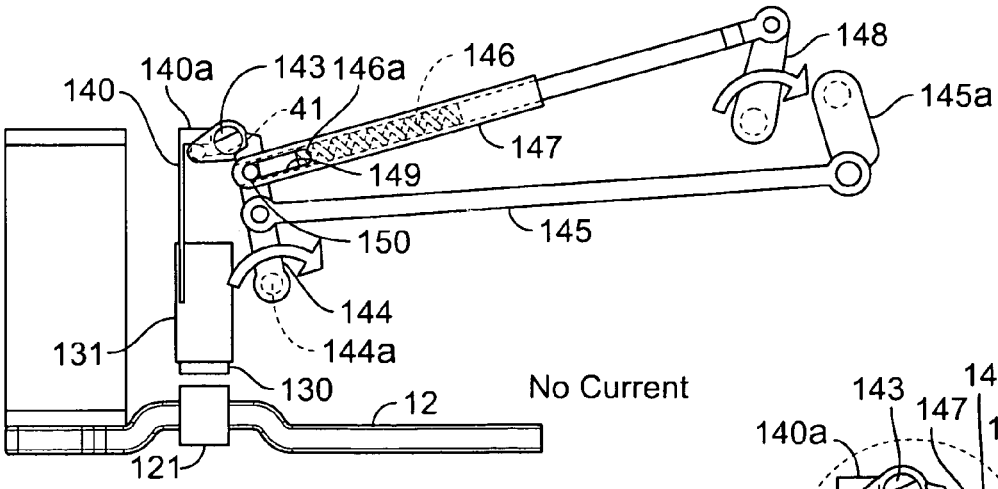
Figure 21D:
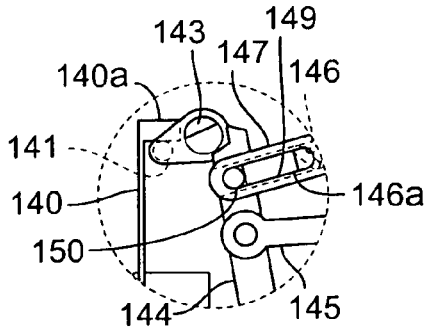
Figure 20E:
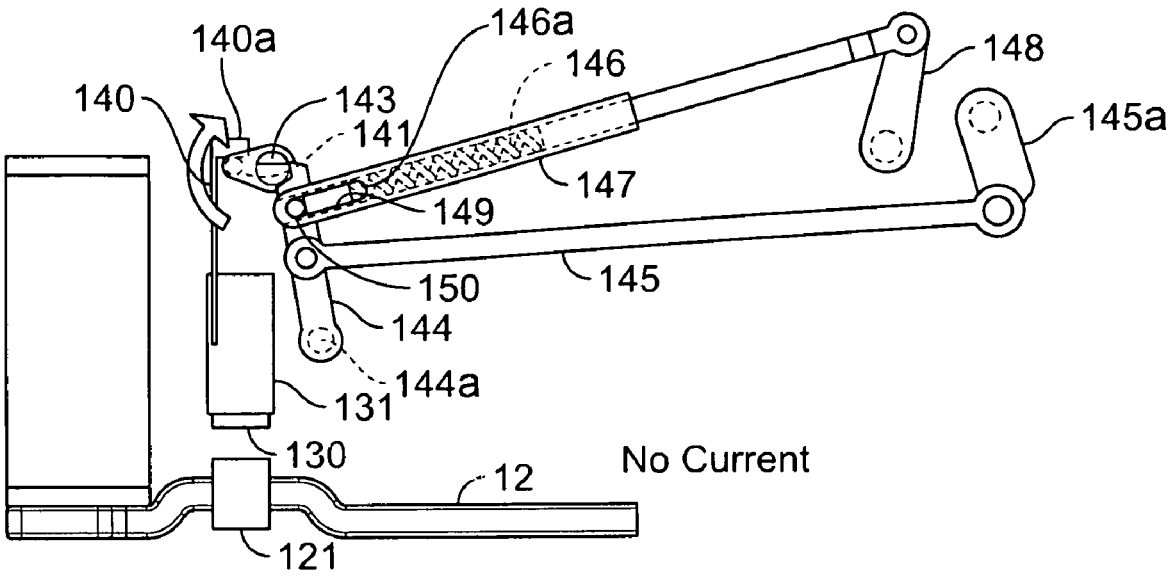
Figure 21E:
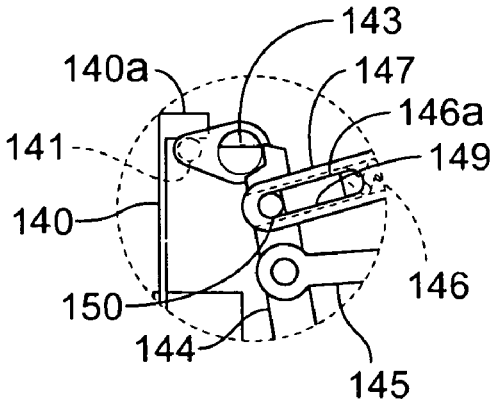

When the host breaker mechanism is reset after being tripped, e.g., by use of the manual toggle 17, a charging and reset lever 148, serving as the mechanical reset arm, is pivoted in a clockwise direction, as indicated by the arrow in FIG. 20D. This movement of the lever 148 pulls the cylinder 147 to the right (as viewed in FIG. 20D), causing the left-hand end of the slot 149 to engage the pin 150 of the hook link 144 and pivot both the hook link 144 and the reset lever 148 in clockwise directions, as indicated by the arrows in FIG. 20D, back to their original positions. This return movement of the hook link 144 also returns both the trip link 145 and the tripping lever 45*a* to their original untripped positions, as illustrated in FIG. 20D.

The movement of the hook link 144 allows the crossbar 143 to be rotated in a clockwise direction back to its latched position, shown in FIGS. 20E, 21E, 20A and 21A, by its return spring (not shown). This return movement of the crossbar 143 is not resisted by the flange 140 because the downward force exerted by the movable magnet 130 on the flange 130 is terminated when the host breaker is tripped, interrupting the current flow responsible for that downward force. Then when the lever 148 subsequently returns to its original position shown in FIG. 20A, it moves the cylinder to the left (as viewed in FIGS. 20E, 21E, 20A and 21A), which compresses the spring 146 by advancing the left-hand end of the slot 149 beyond the pin 150 of the latched hook link 144.

The entire actuating mechanism between the movable ferromagnetic elements 130 and the trip mechanism of the host circuit breaker is preferably made of a non-conductive material, such as a polymeric material, to avoid any undesired induced currents or magnetic fluxes. The use of a polymeric material also permits a substantial portion of the actuator to be molded as a single piece, e.g., the crossbar 143 and the links 142, 144 and 145.

Figure 22:
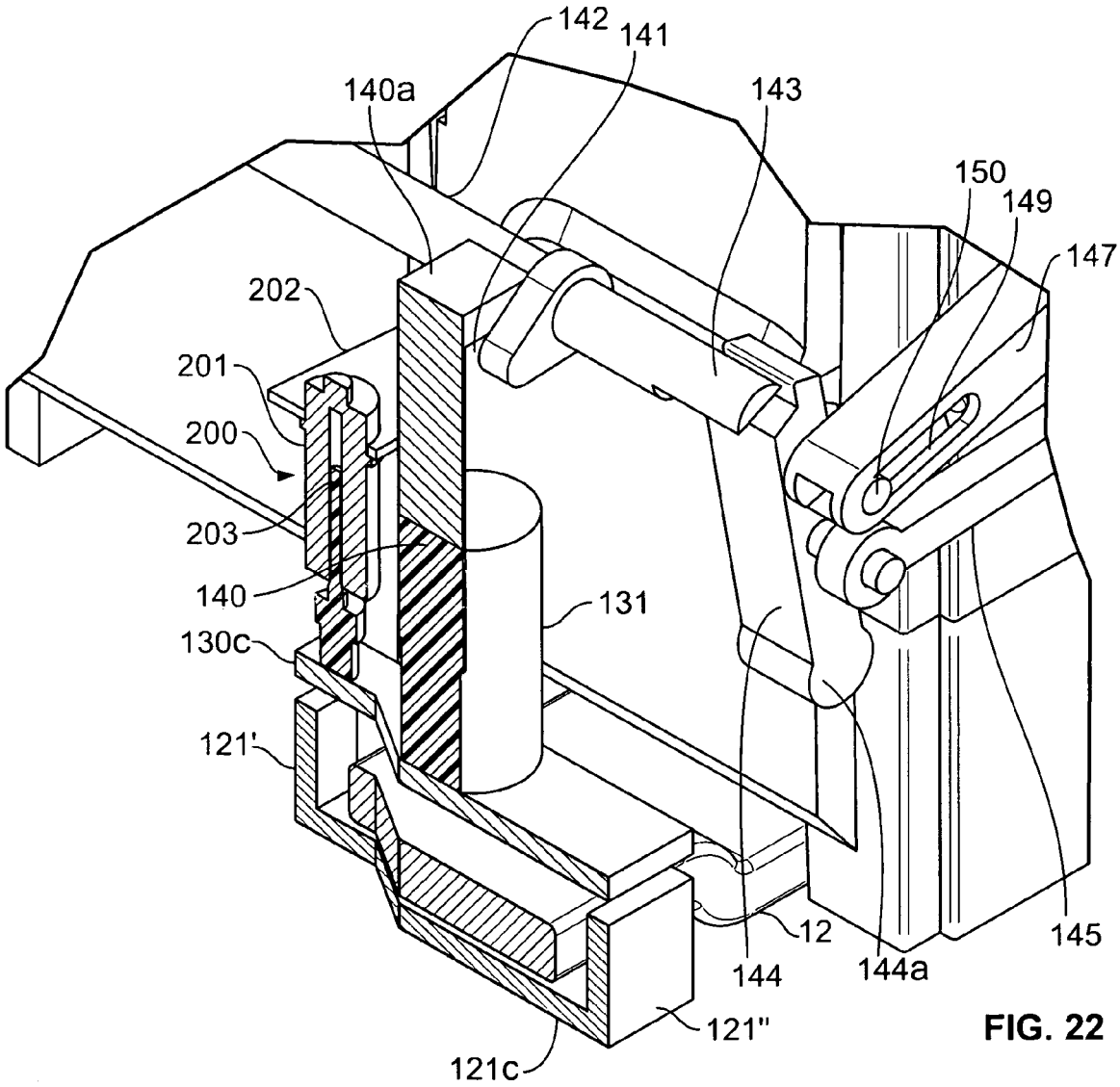
FIG. 22 is a sectional view of a modified embodiment of a mechanical actuating mechanism for use in the add-on module of FIGS. 14-21E.

FIG. 22 illustrates a modified add-on module that includes a dashpot 200 that introduces a delay in the tripping of the circuit breaker by resisting upward movement of the movable ferromagnetic element 130 via viscous friction. The cylinder 201 of the dashpot 200 is mounted on a bracket 202 attached to the circuit breaker housing, so it has a stationary position. The rod 203 of the dashpot is mounted on the movable ferromagnetic element 130 and extends vertically into the cylinder 201 so that the upward movement of the element 130 is damped by hydraulic fluid within the cylinder, thereby reducing the rate at which the element 130 moves upwardly. This delay can avoid an undesired trip of the circuit breaker by a spurious momentary increase in the electrical current in the corresponding terminal 12. Although only one of the electromechanical transducers is shown equipped with a dashpot 200 in FIG. 22, it will be understood that three separate dashpots are coupled to the respective movable ferromagnetic elements 130*a*-130*c*.

The add-on module 120 permits the electronic sensing and trip-actuating portions of an electronic multi-pole circuit breaker to be easily replaced with an electromechanical sensing and trip-actuating device suitable for use with AC and DC power systems. The basic mechanical structure of the host circuit breaker used with the electronic actuator is still used with the add-on module, thus taking advantage of the economics of mass production of that basic mechanical structure. The add-on module itself can be manufactured and assembled at a relatively low cost because it has a small number of parts that are easily assembled.

Figure 23:
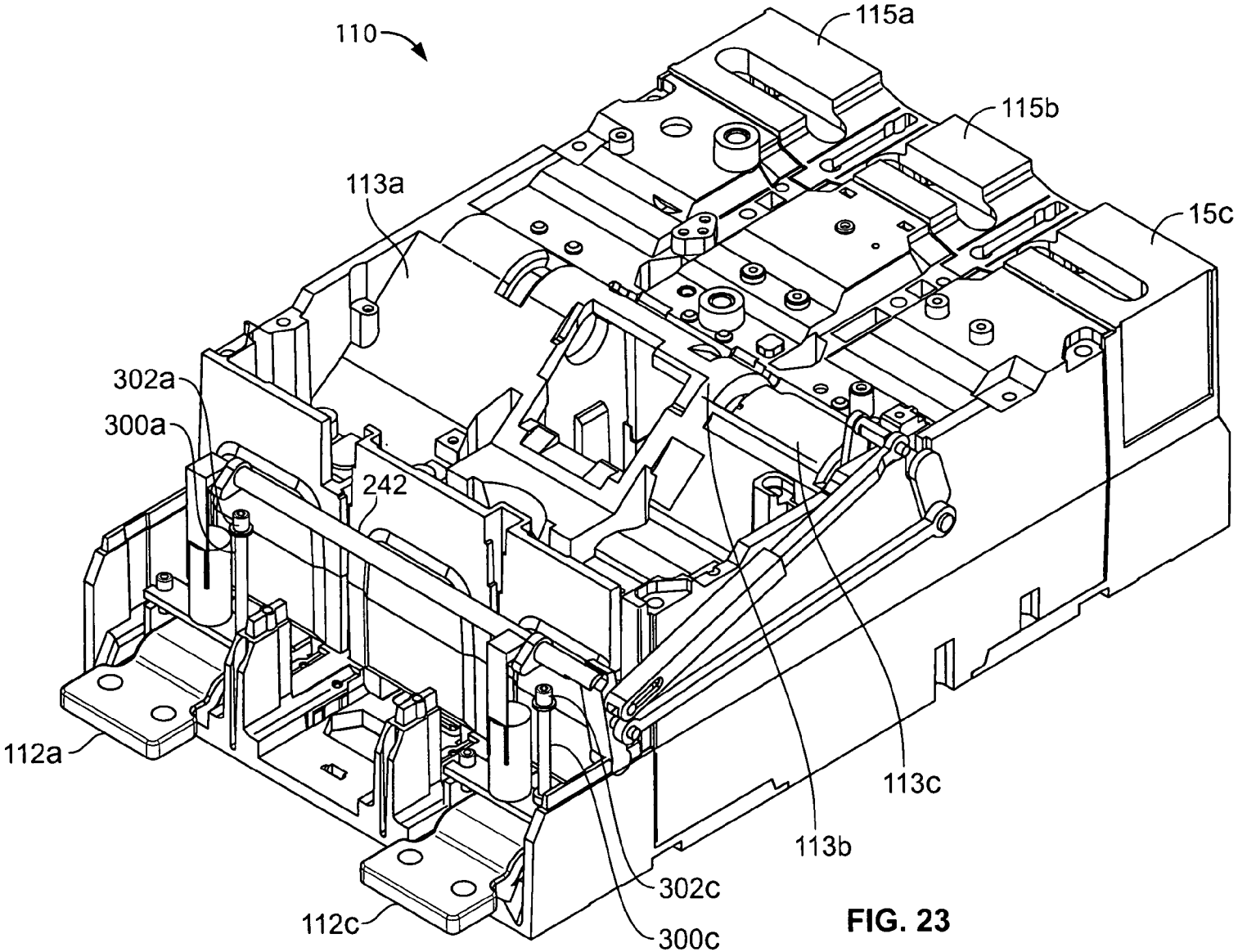
FIG. 23 is a perspective view of a modified add-on module that includes an externally accessible adjustment for adjusting the size of the air gap between stationary and movable ferromagnetic elements.
Figure 24:
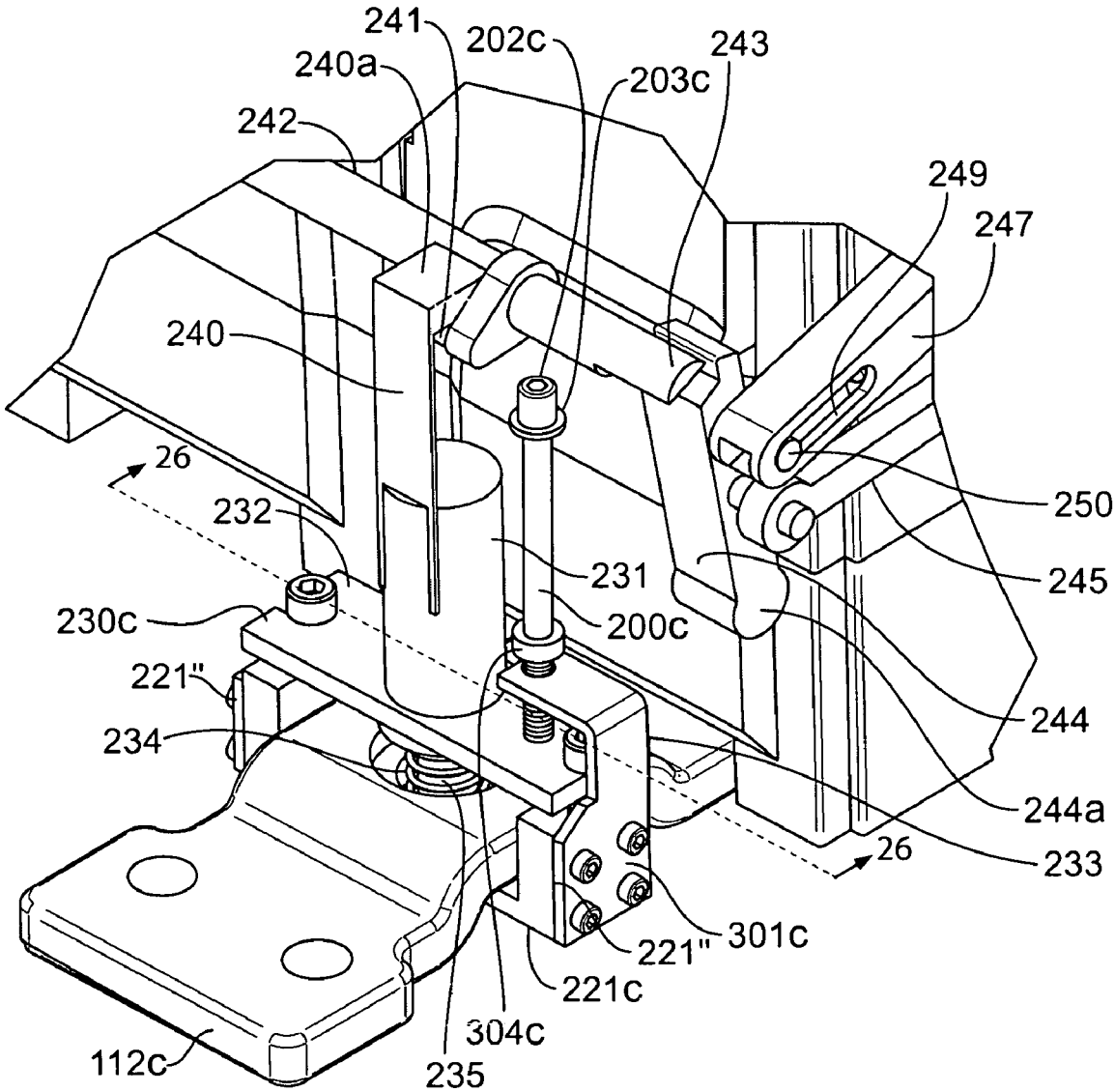
FIG. 24 is an enlarged perspective view of the right-hand end of the add-on module shown in FIG. 23.
Figure 25:
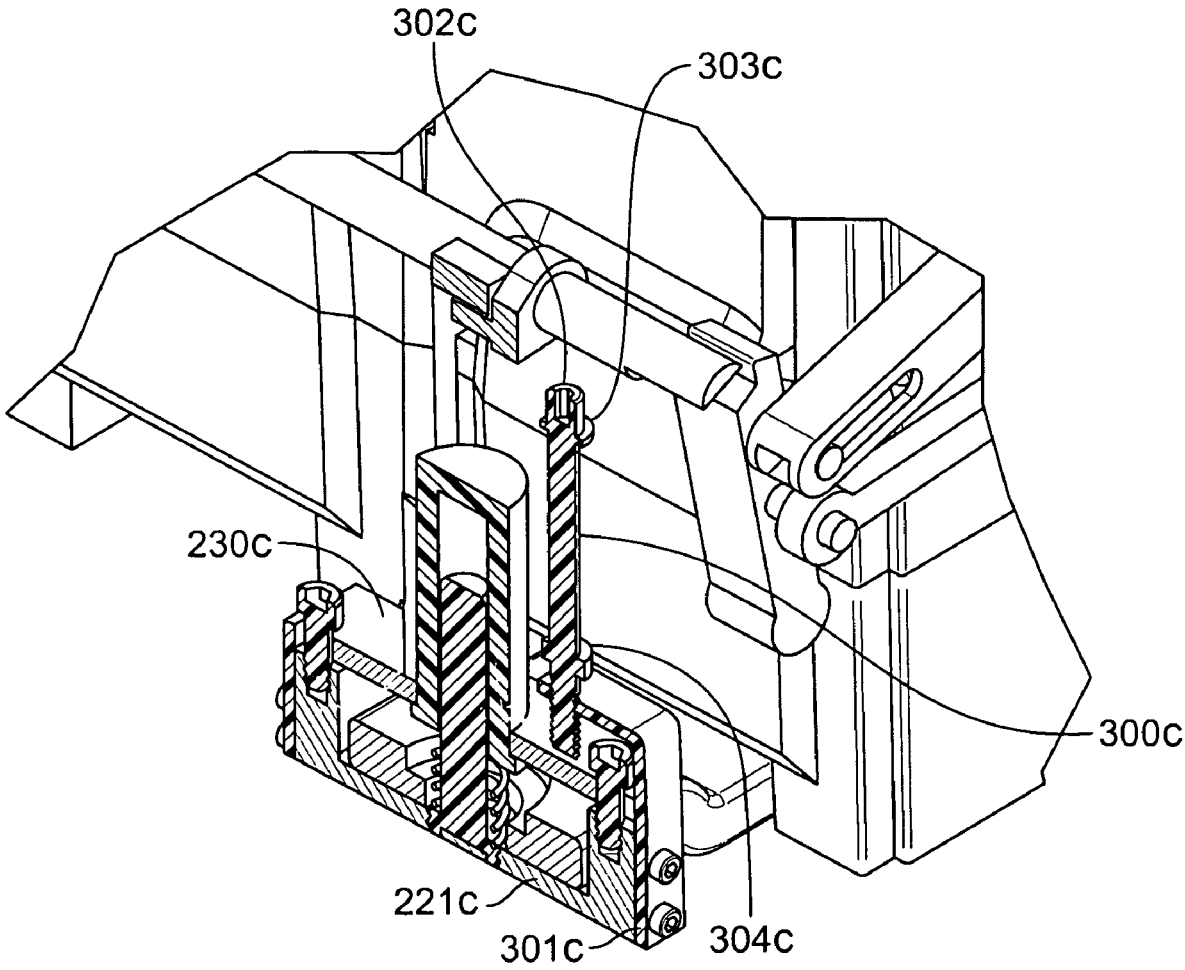
FIG. 25 is an enlarged sectional view taken along line 25-25 in FIG. 24.

FIGS. 23-25 illustrate a modified add-on module that includes externally accessible adjustment screws 300*a*-300*c* for adjusting the size of the air gap between the respective stationary ferromagnetic elements 121*a*-121*c* and the corresponding movable ferromagnetic elements 130*a*-130*c*. The screws 300*a*-300*c* are threaded through and supported by respective stationary brackets 301*a*-301*c*. The lower ends of the screws 300*a*-300*c* engage the upper surfaces of the respective movable ferromagnetic elements 130*a*-130*c* so that the uppermost positions of the movable ferromagnetic elements 130*a*-130*c* can be adjusted by turning the screws 300*a*-300*c* to raise or lower the vertical positions of the lower ends of the screws. Changing the uppermost positions of the movable ferromagnetic elements 130*a*-130*c* changes the maximum air gaps between the respective stationary ferromagnetic elements 121*a*-121*c* and the corresponding movable ferromagnetic elements 130*a*-130*c*, which in turn alters the time required to trip the breaker in response to a predetermined increase in the current level.

The shanks of the screws 300*a*-300*c* are vertically elongated so that the screw heads 302*a*-302*c* extend upwardly into mating apertures (not shown) in the housing of the add-on module 120 so that sockets in the upper ends of the screw heads 302*a*-302*c* are accessible through the respective apertures. The user can use a driver that mates with the sockets to turn the screws 300*a*-300*c* without removing the housing of the module 120. Flanges 303*a*-303*c* at the bases of the respective screw heads 302*a*-302*c* overlap the lower surface of the upper wall of the housing of the module 120 to limit the upward movement of the respective screws 300*a*-300*c* to prevent inadvertent removal of the screws from the brackets 300*a*-300*c*. Flanges 304*a*-304*c* at the lower ends of the shanks of the screws 300*a*-300*c* limit the downward movement of the respective screws, thereby limiting the minimum size of the respective air gaps.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

The invention claimed is:

1. In a multiple-pole circuit breaker comprising a host circuit breaker having a basic mechanical structure that includes, for each pole, a power input terminal and a power output terminal, a pair of contacts each of which is connected to a different one of said terminals and at least one of which is movable, a trip mechanism coupled to said movable contact for opening said contacts by disengaging said movable contact from the other contact in said pair, an electronic trip system that includes a plurality of current sensors producing signals related to the electrical current flow between said power input and output terminals, and a control circuit receiving said signals, detecting the occurrence of a fault condition, and producing an electrical trip signal when a fault condition is detected, a solenoid receiving said trip signal and coupled to said trip mechanism for moving said trip mechanism to open said contacts in response to said trip signal, and a manually operable actuator coupled to said movable contact for operating and resetting said trip mechanism, the improvement comprising an add-on module adapted to be attached to said basic mechanical structure and including multiple extended terminals each of which is adapted to replace one of said extended terminals for one of said phase lines, multiple electromechanical transducers each of which is coupled to one of said extended terminals for producing a mechanical movement in response to a predetermined magnitude of electrical current in the extended terminal to which that transducer is coupled, a mechanical trip link coupled to said electromechanical transducers and to said movable contacts for operating said trip mechanism in response to a predetermined movement of any of said transducers, and a calibration element for adjusting mechanical movement of at least one of said multiple electromechanical transducers to control an aspect of trip actuation.

2. The multiple-pole circuit breaker of claim 1 wherein said aspect is a predetermined magnitude of electrical current.

3. The multiple-pole circuit breaker of claim 1 wherein said aspect is a rate of movement of the transducer.

4. The multiple-pole circuit breaker of claim 1 wherein said calibration element adjusts said predetermined magnitude of electrical current at which said mechanical movement is produced by each of said transducers.

5. The multiple-pole circuit breaker of claim 4 which includes a biasing spring resisting said mechanical movement until said electrical current in said extended terminal to which that transducer is coupled is increased to a predetermined level, and said calibration element is coupled to said biasing spring for adjusting the resisting force of said biasing spring and thereby adjusting said predetermined level of electrical current.

6. The multiple-pole circuit breaker of claim 1 in which said multiple electromechanical transducers comprise multiple stationary ferromagnetic elements each of which is coupled to one of said extended terminals to produce a magnetic flux having a strength related to the magnitude of the electrical current in the corresponding extended terminal, and multiple movable ferromagnetic elements each of which is mounted adjacent one of said stationary ferromagnetic elements for movement in response to a preselected change in the magnetic flux produced by the corresponding stationary ferromagnetic element.

7. The multiple-pole circuit breaker of claim 1 in which each of said electromechanical transducers comprises a thermomechanical element attached to one of said extended terminals for producing a mechanical displacement in response to the heating of said thermomechanical element by electrical current in the extended terminal to which that transducer is attached.

8. The multiple-pole circuit breaker of claim 1 in which said mechanical trip link includes a mechanical reset arm coupling said manually operable actuator to said mechanical trip link for resetting said trip link in response to the resetting of said host circuit breaker, a latch having a latched condition holding said trip link in an untripped position, and an unlatched condition releasing said trip link for movement to a tripped position, and a latch release mechanism for moving said latch to said unlatched condition in response to said predetermined movement of any of said transducers.

9. The multiple-pole circuit breaker of claim 8 which includes an energy storage device coupled to said latch and said trip link for moving said trip link to said tripped position in response to the movement of said latch to said unlatched position.

10. The multiple-pole circuit breaker of claim 1 in which each of said electromechanical transducers includes a stationary ferromagnetic element coupled to one of said extended terminals and a movable ferromagnetic element spaced from said stationary ferromagnetic element by an air gap and mounted for mechanical movement in response to a predetermined magnitude of electrical current in the extended terminals to which said stationary ferromagnetic element is coupled, and said calibration element includes an adjustment screw for adjusting the position of each of said movable ferromagnetic elements to change the size of said air gap between said movable ferromagnetic element and the corresponding stationary ferromagnetic element.

11. The multiple-pole circuit breaker of claim 10 which includes an add-on module housing that includes multiple apertures each of which is associated with one of said transducers, and in which each of said adjustment screws extends into one of said apertures so that the screw is accessible for adjustment from outside said housing.

12. The multiple-pole circuit breaker of claim 10 in which said multiple electromechanical transducers comprise multiple stationary ferromagnetic elements each of which is coupled to one of said extended terminals to produce a magnetic flux having a strength related to the magnitude of the electrical current in the corresponding extended terminal, and multiple movable ferromagnetic elements each of which is mounted adjacent one of said stationary ferromagnetic elements for movement in response to a preselected change in the magnetic flux produced by the corresponding stationary ferromagnetic element.

13. The multiple-pole circuit breaker of claim 10 in which each of said electromechanical transducers comprises a thermomechanical element attached to one of said extended terminals for producing a mechanical displacement in response to the heating of said thermomechanical element by electrical current in the extended terminals to which that transducer is attached.

14. The multiple-pole circuit breaker of claim 10 in which said mechanical trip link includes a mechanical reset arm coupling said reset mechanism to said mechanical actuator for resetting said trip link in response to the resetting of said host circuit breaker a trip link coupled to said trip mechanism for actuating said trip mechanism to open said contacts, a latch having a latched condition holding said trip link in an untripped position, and an unlatched condition releasing said trip link for movement to a tripped position, and a latch release mechanism for moving said latch to said unlatched condition in response to said predetermined movement of any of said transducers.

15. The multiple-pole circuit breaker of claim 14 which includes an energy storage device coupled to said latch and said trip link for moving said trip link to said tripped position in response to the movement of said latch to said unlatched position.

16. The multiple-pole circuit breaker of claim 10 in which each of said multiple electromechanical transducers includes a movable element and is coupled to one of said extended terminals for producing a mechanical movement of said movable element in response to a predetermined magnitude of electrical current in the extended terminals to which the transducer is coupled, and said calibration element includes a dashpot coupled to one of said movable elements for controlling the rate of movement of said movable element.

17. The multiple-pole circuit breaker of claim 16 in which said multiple electromechanical transducers comprise multiple stationary ferromagnetic elements each of which is coupled to one of said extended terminals to produce a magnetic flux having a strength related to the magnitude of the electrical current in the corresponding extended terminal, and multiple movable ferromagnetic elements each of which is mounted adjacent one of said stationary ferromagnetic elements for movement in response to a preselected change in the magnetic flux produced by the corresponding stationary ferromagnetic element.

18. In a multiple-pole circuit breaker comprising a host circuit breaker having a basic mechanical structure that includes, for each pole, a power input terminal and a power output terminal, a pair of contacts each of which is connected to a different one of said terminals and at least one of which is movable, a trip mechanism coupled to said movable contact for opening said contacts by disengaging said movable contact from the other contact in said pair, an electronic trip system that includes a plurality of current sensors producing signals related to the electrical current flow between said power input and output terminals, and a control circuit receiving said signals, detecting the occurrence of a fault condition, and producing an electrical trip signal when a fault condition is detected, a solenoid receiving said trip signal and coupled to said trip mechanism for moving said trip mechanism to open said contacts in response to said trip signal, and a manually operable trip link coupled to said movable contact for operating and resetting said trip mechanism, the improvement comprising an add-on module adapted to be attached to said basic mechanical structure and including multiple extended terminal plates each of which is adapted to replace one of said terminal plates for one of said phase lines, multiple electromechanical transducers each of which is coupled to one of said extended terminal plates for producing a mechanical movement in response to a predetermined magnitude of electrical current in the extended terminal to which that transducer is coupled, a mechanical trip link coupled to said electromechanical transducers and to said movable contacts for operating said trip mechanism in response to a predetermined movement of any of said transducers, and a calibration element for adjusting mechanical movement of at least one of said multiple electromechanical transducers to control an aspect of trip actuation.

19. The multiple-pole circuit breaker of claim 18 wherein said aspect is a predetermined magnitude of electrical current.

20. The multiple-pole circuit breaker of claim 18 wherein said aspect is a rate of movement of the transducer.

* * * * *